US010584302B2

(12) United States Patent
Tamura

(10) Patent No.: US 10,584,302 B2
(45) Date of Patent: Mar. 10, 2020

(54) LUBRICATING OIL COMPOSITION AND METHOD FOR MANUFACTURING SAID LUBRICATING OIL COMPOSITION

(71) Applicant: IDEMITSU KOSAN CO., LTD., Chiyoda-ku (JP)

(72) Inventor: Kazushi Tamura, Kawasaki (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/511,774

(22) PCT Filed: Sep. 18, 2015

(86) PCT No.: PCT/JP2015/076808

§ 371 (c)(1),
(2) Date: Mar. 16, 2017

(87) PCT Pub. No.: WO2016/043333

PCT Pub. Date: Mar. 24, 2016

(65) Prior Publication Data

US 2017/0298287 A1 Oct. 19, 2017

(30) Foreign Application Priority Data

Sep. 19, 2014 (JP) ..... 2014-191905

(51) Int. Cl.

| | |
|---|---|
| ***C10M 173/02*** | (2006.01) |
| ***C10L 1/22*** | (2006.01) |
| ***C08K 5/01*** | (2006.01) |
| ***C10M 129/54*** | (2006.01) |
| ***C10M 161/00*** | (2006.01) |
| ***C10M 163/00*** | (2006.01) |
| ***C10M 139/00*** | (2006.01) |
| ***C10M 125/26*** | (2006.01) |
| ***C10M 107/02*** | (2006.01) |
| ***C10M 133/44*** | (2006.01) |
| ***C10M 169/04*** | (2006.01) |

(52) U.S. Cl.

CPC ..... *C10M 161/00* (2013.01); *C10M 107/02* (2013.01); *C10M 125/26* (2013.01); *C10M 133/44* (2013.01); *C10M 139/00* (2013.01); *C10M 163/00* (2013.01); *C10M 169/044* (2013.01); *C10M 2201/087* (2013.01); *C10M 2203/1025* (2013.01); *C10M 2205/0285* (2013.01); *C10M 2207/028* (2013.01); *C10M 2207/262* (2013.01); *C10M 2209/084* (2013.01); *C10M 2215/28* (2013.01); *C10M 2215/30* (2013.01); *C10M 2219/044* (2013.01); *C10M 2219/046* (2013.01); *C10M 2219/068* (2013.01); *C10M 2223/045* (2013.01); *C10M 2227/06* (2013.01); *C10M 2227/09* (2013.01); *C10N 2210/02* (2013.01); *C10N 2210/06* (2013.01); *C10N 2220/021* (2013.01); *C10N 2220/029* (2013.01); *C10N 2230/04* (2013.01); *C10N 2230/54* (2013.01); *C10N 2230/68* (2013.01); *C10N 2240/104* (2013.01); *C10N 2240/105* (2013.01)

(58) Field of Classification Search

CPC C10M 145/14; C10M 129/10; C10M 125/26; C10M 125/24; C10M 145/12

USPC ..... 508/264, 156, 518

See application file for complete search history.

(56) References Cited

U.S. PATENT DOCUMENTS

| | | | | |
|---|---|---|---|---|
| 2008/0076686 | A1 | 3/2008 | Nakazato et al. | |
| 2010/0190671 | A1 | 7/2010 | Stoehr et al. | |
| 2013/0184189 | A1* | 7/2013 | Baker | C10M 161/00 508/186 |
| 2013/0196888 | A1 | 8/2013 | Truong-Dinh | |

FOREIGN PATENT DOCUMENTS

| | | | |
|---|---|---|---|
| CN | 102348789 | A | 2/2012 |
| JP | 2005-306913 | A | 11/2005 |
| JP | 2008-106255 | A | 5/2008 |
| JP | 2013-536293 | A | 9/2013 |
| JP | 2014-152301 | A | 8/2014 |
| WO | WO 2013/118363 | A1 | 8/2013 |
| WO | WO 2013/189951 | A1 | 12/2013 |

OTHER PUBLICATIONS

International Search Report dated Nov. 2, 2015, in PCT/JP2015/076808, filed Sep. 18, 2015.

Extended European Search Report dated Mar. 22, 2018 in corresponding European Patent Application No. 15842968.8 citing documents AA, AO and AP therein, 8 pages.

Office Action dated Aug. 5, 2019, in Chinese Patent Application No. 201580050241.X, filed Sep. 18, 2015.

Office Action dated Oct. 31, 2019, in Indian Patent Application No. 201747009610, filed Mar. 20, 2017.

* cited by examiner

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

The lubricating oil composition of the present invention contains, together with a base oil, a viscosity index improver (A) including a comb-shaped polymer (A1), a detergent dispersant (B) including an alkali metal borate (B1) and an organometallic compound (B2) containing a metal atom selected from an alkali metal atom and an alkaline earth metal atom, and a friction modifier (C) including a molybdenum-containing friction modifier, with the total content of an alkali metal atom and an alkaline earth metal atom being 2,000 mass ppm or less. The lubricating oil composition of the present invention has excellent detergency, fuel saving properties, and LSPI-preventing properties.

20 Claims, No Drawings

LUBRICATING OIL COMPOSITION AND METHOD FOR MANUFACTURING SAID LUBRICATING OIL COMPOSITION

CROSS-REFERENCE TO RELATED APPLICATIONS

This application is a National Phase of PCT/JP2015/076808, which was filed on Sep. 18, 2015. This application is based upon and claims the benefit of priority to Japanese Application No. 2014-191905, which was filed on Sep. 19, 2014.

TECHNICAL FIELD

The present invention relates to a lubricating oil composition and a method for producing the lubricating oil composition.

BACKGROUND ART

In recent years, the environmental regulation on a global scale is becoming severe more and more, and the circumstances surrounding automobiles are getting severe from the aspects of fuel consumption regulations, exhaust gas regulations, and so on. In particular, an improvement of fuel consumption performance of vehicles, such as automobiles, etc., is a big issue. As one means for solving that issue, an improvement in fuel saving properties of a lubricating oil composition to be used for vehicles is demanded.

For improving the fuel saving properties of a lubricating oil composition, a polymethacrylate (PMA) is, in general, used as a viscosity index improver to be blended in the lubricating oil composition.

However, in general, it is known that when a lubricating oil composition including a viscosity index improver, such as PMA, etc., is used under high temperature high shear viscosity conditions, the detergency is worsened. Therefore, it is performed to increase a blending amount of a metallic detergent in the lubricating oil composition, or to investigate a suitable combination of metallic detergents.

For example, PTL 1 proposes a lubricating oil composition in which predetermined amounts of a nitrogen-containing ashless dispersant, a metal-containing detergent, an alkali metal borate hydrate, and specified zinc dihydrocarbyl dithiophosphate are blended together with a viscosity index improver, such as PMA, an ethylene-propylene copolymer, etc., in a lubricating base oil, and the blend is dissolved or dispersed.

CITATION LIST

Patent Literature

PTL 1: JP 2005-306913 A

SUMMARY OF INVENTION

Technical Problem

However, the lubricating oil composition described in PTL 1 is one for diesel engines, and its fuel saving properties are not satisfactory. In addition, in recent years, in gasoline engine vehicles, for the purpose of improving the fuel consumption, introduction of direct-injection supercharged engines is advancing. In a lubricating oil composition to be used for direct-injection supercharged engines, higher fuel saving properties and detergency are required. Therefore, the lubricating oil composition described in PTL 1 is hard to be suited as a lubricating oil for direct-injection supercharged gasoline engines.

Furthermore, in order to improve the fuel saving properties of the lubricating oil composition, it is also performed to blend a molybdenum-containing friction modifier in the lubricating oil composition. However, the molybdenum-containing friction modifier involved such a problem that the detergency of the lubricating oil composition is worsened.

In order to improve the detergency of the lubricating oil composition, it is also performed to increase the blending amount of a metallic detergent in the lubricating oil composition. However, in the lubricating oil for direct-injection supercharged gasoline engines, it is understood that when the blending amount of the metallic detergent is increased, such an abuse that abnormal combustion (low-speed pre-ignition, LSPI) following ignition of an engine oil is liable to generate is caused. Therefore, from the viewpoint of preventing the generation of LSPI, it is necessary to reduce the blending amount of the metallic detergent in the lubricating oil composition as far as possible.

Therefore, a lubricating oil composition capable of solving these problems and improving detergency, fuel saving properties, and LSPI-preventing properties with a good balance, which is also applicable for direct-injection supercharged gasoline engines, has been desired.

In view of the foregoing circumstances, the present invention has been made, and an object thereof is to provide a lubricating oil composition having excellent detergency, fuel saving properties, and LSPI-preventing properties and a method for producing the lubricating oil composition.

Solution to Problem

The present inventor made extensive and intensive investigations, and as a result, it has been found that a lubricating oil composition using a comb-shaped polymer as a viscosity index improver and further containing a detergent dispersant including an alkali metal borate and a specified organometallic compound and a molybdenum-containing friction modifier together with a base oil, in which the contents of an alkali metal atom and an alkaline earth metal atom or the content of a calcium atom is regulated, is able to solve the aforementioned problem, leading to accomplishment of the present invention.

Specifically, the present invention provides the following [1] to [4].

[1] A lubricating oil composition containing, together with a base oil, a viscosity index improver (A) including a comb-shaped polymer (A1), a detergent dispersant (B) including an alkali metal borate (B1) and an organometallic compound (B2) containing a metal atom selected from an alkali metal atom and an alkaline earth metal, and a friction modifier (C) including a molybdenum-containing friction modifier, with the total content of an alkali metal atom and an alkaline earth metal atom being 2,000 mass ppm or less.

[2] A lubricating oil composition containing, together with a base oil, a viscosity index improver (A) including a comb-shaped polymer (A1), a detergent dispersant (B) including an alkali metal borate (B1) and an organometallic compound (B2) containing a metal atom selected from an alkali metal atom and an alkaline earth metal atom, and a friction modifier (C) including a molybdenum-containing friction modifier, with the content of a calcium atom being 1,900 mass ppm or less.

[3] A use method of a lubricating oil composition including using the lubricating oil composition as set forth above in [1] or [2] for direct-injection supercharged gasoline engines.

[4] A method for producing a lubricating oil composition including a step (I) of blending a base oil with a viscosity index improver (A) including a comb-shaped polymer (A1), a detergent dispersant (B) including an alkali metal borate (B1) and an organometallic compound (B2) containing a metal atom selected from an alkali metal atom and an alkaline earth metal atom, and a friction modifier (C) including a molybdenum-containing friction modifier, thereby preparing a lubricating oil composition such that the total content of an alkali metal atom and an alkaline earth metal atom is 2,000 mass ppm or less, or the content of a calcium atom is 1,900 mass ppm or less.

Advantageous Effects of Invention

The lubricating oil composition of the present invention has excellent detergency, fuel saving properties, and LSPI-preventing properties and has properties in such a high level that it is also applicable for direct-injection supercharged gasoline engines.

DESCRIPTION OF EMBODIMENTS

In the present invention, each of the contents of an alkali metal atom, an alkaline earth metal atom, a boron atom, a molybdenum atom, and a phosphorus atom in the lubricating oil composition is a value measured in conformity with JPI-5S-38-92, and the content of a nitrogen atom means a value measured in conformity with JIS K2609.

In the present specification, a "kinematic viscosity at 40° C. or 100° C." and a "viscosity index" mean values as measured in conformity with JIS K2283.

In the present specification, each of a weight average molecular weight (Mw) and a number average molecular weight (Mn) means a value in terms of standard polystyrene, as measured by the gel permeation chromatography (GPC), and specifically, it means a value as measured by the following measurement apparatus under the following measurement conditions.

(Measurement Apparatus)

Gel permeation chromatograph ("1260 Model HPLC", manufactured by Agilent)

(Measuring Conditions)

Column: One in which two of "Shodex LF404" are successively connected to each other Column temperature: 35° C.

Developing solvent: Chloroform

Flow rate: 0.3 mL/min

In the present specification, the "alkali metal atom" refers to a lithium atom (Li), a sodium atom (Na), a potassium atom (K), a rubidium atom (Rb), a cesium atom (Cs), and a francium atom (Fr).

The "alkaline earth metal atom" refers to a beryllium atom (Be), a magnesium atom (Mg), a calcium atom (Ca), a strontium atom (Sr), and a barium atom (Ba).

Furthermore, in the present specification, for example, the "(meth)acrylate" is used as a terminology expressing both an "acrylate" and a "methacrylate", and other analogous terms or similar expressions are also the same.

[Lubricating Oil Composition]

The lubricating oil composition of the present invention contains, together with a base oil, a viscosity index improver (A) (component (A)) including a comb-shaped polymer (A1) (component (A1)), a detergent dispersant (B) (component (B)) including an alkali metal borate (B1) (component (B1)) and an organometallic compound (B2) (component (B2)) containing a metal atom selected from an alkali metal atom and an alkaline earth metal atom, and a friction modifier (C) (component (C)) including a molybdenum-containing friction modifier.

It is preferred that the lubricating oil composition according to the embodiment of the present invention may further contain an anti-wear agent or an antioxidant within the range where the effects of the present invention are not impaired, and the lubricating oil composition according to the embodiment of the present invention may also contain other general-purpose additives than those materials.

In the lubricating oil composition of the present invention, the total content of the alkali metal atom and the alkaline earth metal atom is 2,000 mass ppm or less on a basis of the total amount (100 mass %) of the lubricating oil composition.

When the total content of the alkali metal atom and the alkaline earth metal atom is more than 2,000 mass ppm, a spontaneous ignition temperature of the obtained lubricating oil composition becomes low, and the frequency of LSPI generation tends to become high.

From the viewpoint of an improvement of LSPI-preventing properties, the total content of the alkali metal atom and the alkaline earth metal atom is preferably 1,800 mass ppm or less, more preferably 1,700 mass ppm or less, still more preferably 1,500 mass ppm or less, and yet preferably 1,300 mass ppm or less on a basis of the total amount (100 mass %) of the lubricating oil composition.

On the other hand, from the viewpoint of an improvement of detergency, the total content of the alkali metal atom and the alkaline earth metal atom is preferably 100 mass ppm or more, more preferably 200 mass ppm or more, still more preferably 300 mass ppm or more, and yet still more preferably 500 mass ppm or more on a basis of the total amount (100 mass %) of the lubricating oil composition.

In the lubricating oil composition according to another embodiment of the present invention, the content of the calcium atom is 1,900 mass ppm or less, preferably 1,700 mass ppm or less, more preferably 1,500 mass ppm or less, still more preferably 1,300 mass ppm or less, and yet still more preferably 1,100 mass ppm or less from the viewpoint of an improvement of LSPI-preventing properties, and preferably 100 mass ppm or more, more preferably 200 mass ppm or more, still more preferably 300 mass ppm or more, and yet still more preferably 500 mass ppm or more from the viewpoint of an improvement of detergency, on a basis of the total amount (100 mass %) of the lubricating oil composition.

In the lubricating oil composition according to the embodiment of the present invention, the total content of the sodium atom, the magnesium atom, the calcium atom, and the barium atom is preferably 1,900 mass ppm or less, preferably 1,700 mass ppm or less, more preferably 1,500 mass ppm or less, still more preferably 1,300 mass ppm or less, and yet still more preferably 1,100 mass ppm or less from the viewpoint of an improvement of LSPI-preventing properties, and preferably 100 mass ppm or more, more preferably 200 mass ppm or more, still more preferably 300 mass ppm or more, and yet still more preferably 500 mass ppm or more from the viewpoint of an improvement of detergency, on a basis of the total amount (100 mass %) of the lubricating oil composition.

In the lubricating oil composition according to the embodiment of the present invention, the total content of the alkaline earth metals is preferably 1,900 mass ppm or less, preferably 1,700 mass ppm or less, more preferably 1,500 mass ppm or less, still more preferably 1,300 mass ppm or less, and yet still more preferably 1,100 mass ppm or less from the viewpoint of an improvement of LSPI-preventing properties, and preferably 100 mass ppm or more, more preferably 200 mass ppm or more, still more preferably 300 mass ppm or more, and yet still more preferably 500 mass ppm or more from the viewpoint of an improvement of detergency, on a basis of the total amount (100 mass %) of the lubricating oil composition.

In the content of the predetermined metal atom in each requirement, which is contained in the aforementioned lubricating oil composition of the present invention, not only the content of the foregoing metal atom derived from the components (B1) and (B2) but also the content of the foregoing metal atom derived from other compound than these components is included.

In the lubricating oil composition according to the embodiment of the present invention, the total content of the base oil, the component (A), the component (B), and the component (C) is preferably 70 mass % or more, more preferably 75 mass % or more, still more preferably 80 mass % or more, yet still more preferably 85 mass % or more, and even yet still more preferably 90 mass % or more, and typically 100 mass % or less, more preferably 99.9 mass % or less, and still more preferably 99 mass % or less, on a basis of the total amount (100 mass %) of the lubricating oil composition.

<Base Oil>

The base oil to be contained in the lubricating oil composition according to the embodiment of the present invention may be either a mineral oil or a synthetic oil, and a mixed oil of a mineral oil and a synthetic oil may also be used.

Examples of the mineral oil include atmospheric residues obtained by subjecting a crude oil, such as a paraffinic mineral oil, an intermediate mineral oil, a naphthenic mineral oil, etc., to atmospheric distillation; distillates obtained by subjecting such an atmospheric residue to distillation under reduced pressure; mineral oils and waxes resulting from subjecting the distillate to one or more treatments of solvent deasphalting, solvent extraction, hydro-cracking, solvent dewaxing, catalytic dewaxing, hydrorefining, and the like; mineral oils obtained by isomerizing a wax (GTL wax (gas to liquids wax)) produced by a Fischer-Tropsch process or the like; and the like.

Of those, from the viewpoint of an improvement of LSPI-preventing properties of the lubricating oil composition, a mineral oil and a wax having been subjected to one or more treatments of solvent deasphalting, solvent extraction, hydro-cracking, solvent dewaxing, catalytic dewaxing, hydrorefining, and the like are preferred; a mineral oil classified into Group 2 or Group 3 of the base stock categories of the API (American Petroleum Institute) is more preferred; and a mineral oil classified into the foregoing Group 3 is still more preferred.

Examples of the synthetic oil include poly-α-olefins, such as polybutene and an α-olefin homopolymer or copolymer (for example, a homopolymer or copolymer of an α-olefin having a carbon number of 8 to 14, such as an ethylene-α-olefin copolymer, etc.), etc.; various esters, such as a polyol ester, a dibasic acid ester, a phosphate ester, etc.; various ethers, such as a polyphenyl ether, etc.; a polyglycol; an alkyl benzene; an alkyl naphthalene; synthetic oils obtained by isomerizing a wax (GTL wax) produced by a Fischer-Tropsch process or the like; and the like.

Of those synthetic oils, poly-α-olefins are preferred.

As the base oil that is used in the embodiment of the present invention, from the viewpoint of an improvement of LPSI-preventing properties of the lubricating oil composition and the viewpoint of oxidation stability of the base oil itself, at least one selected from a mineral oil classified into Group 2 or Group 3 of the base stock categories of the API (American Petroleum Institute) and a synthetic oil is preferred, and at least one selected from a mineral oil classified into the foregoing Group 3 and a poly-α-olefin is more preferred.

In the embodiment of the present invention, these base oils may be used alone or in combination of any two or more thereof.

A kinematic viscosity at 100° C. of the base oil that is used in the embodiment of the present invention is preferably 2.0 to 20.0 $mm^2/s$, more preferably 2.0 to 15.0 $mm^2/s$, still more preferably 2.0 to 10.0 $mm^2/s$, and yet still more preferably 2.0 to 7.0 $mm^2/s$.

When the kinematic viscosity at 100° C. of the base oil is 2.0 $mm^2/s$ or more, an evaporation loss is small, and hence, such is preferred. On the other hand, when the kinematic viscosity at 100° C. of the base oil is 20.0 $mm^2/s$ or less, a power loss to be caused due to viscous resistance can be suppressed, and a fuel consumption improving effect is obtained, and hence, such is preferred.

From the viewpoint of not only suppression of a change in viscosity to be caused due to a change in temperature but also an improvement of fuel saving properties, a viscosity index of the base oil that is used in the embodiment of the present invention is preferably 80 or more, more preferably 90 or more, and still more preferably 100 or more.

In the lubricating oil composition according to the embodiment of the present invention, in the case of using a mixed oil composed of a combination of two or more base oils, it is preferred that the kinematic viscosity and the viscosity index of the mixed oil fall within the aforementioned ranges.

In the lubricating oil composition according to the embodiment of the present invention, the content of the base oil is preferably 55 mass % or more, more preferably 60 mass % or more, still more preferably 65 mass % or more, and yet still more preferably 70 mass % or more, and preferably 99 mass % or less, and more preferably 95 mass % or less on a basis of the total amount (100 mass %) of the lubricating oil composition.

<Viscosity Index Improver (A)>

The lubricating oil composition of the present invention contains the viscosity index improver (A) including a comb-shaped polymer (A1).

It is known that when a lubricating oil composition containing PMA that is a general viscosity index improver, or the like is used under high temperature high shear viscosity conditions, the detergency is worsened.

On the other hand, the present inventor has found that when the comb-shaped polymer (A1) is blended as the viscosity index improver in the lubricating oil composition, different from the conventional PMA or the like, conversely an effect for improving the detergency is brought.

The present inventor made extensive and intensive investigation based on the foregoing finding. As a result, it has been found that by containing a combination of the viscosity index improver (A) including the comb-shaped polymer (A1) and the detergent dispersant (B) including the alkali metal borate (B1) and the organometallic compound (B2), a lubricating oil composition with remarkably improved detergency at a high temperature may be provided, leading to accomplishment of the present invention.

The viscosity index improve (A) that is used in the embodiment of the present invention may contain other resin component not corresponding to the comb-shaped polymer (A1), or the unreacted raw materials and catalyst used at the time of synthesis of the comb-shaped polymer (A1) as well as a by-product, such as a resin component as formed at the time of synthesis, which is not corresponding to the comb-shaped polymer, etc., within the range where the effects of the present invention are not impaired.

In the present specification, the aforementioned "resin component" means a polymer having a weight average molecular weight (Mw) of 1,000 or more and having a fixed repeating unit.

Examples of the other resin component not corresponding to the comb-shaped polymer (A1) include polymers not corresponding to the comb-shaped polymer, such as a polymethacrylate, a dispersion type polymethacrylate, an olefin copolymer (for example, an ethylene-propylene copolymer, etc.), a dispersion type olefin copolymer, a styrenic copolymer (for example, a styrene-diene copolymer, a styrene-isoprene copolymer, etc.), etc.

There is also a case where such other resin component is not contained as the viscosity index improver (A), and for example, so long as a polymethacrylate compound is concerned, it is contained as a general-purpose additive, such a pour-point depressant, etc.

However, in the lubricating oil composition according to the embodiment of the present invention, from the viewpoint of suppressing worsening of detergency under high temperature high shear conditions of the lubricating oil composition, it is preferred that the content of the other resin component (particularly a polymethacrylate compound) which is not corresponding to the comb-shaped polymer (A1) is low as far as possible.

The content of the polymethacrylate compound not corresponding to the comb-shaped polymer (A1) is preferably 0 to 30 parts by mass, more preferably 0 to 25 parts by mass, still more preferably 0 to 20 parts by mass, yet still more preferably 0 to 15 parts by mass, even yet still more preferably 0 to 10 parts by mass, and even still more preferably 0 to 5 parts by mass relative to 100 parts by mass of the comb-shaped polymer (A1) included in the lubricating oil composition.

The content of the aforementioned by-product is preferably 10 mass % or less, more preferably 5 mass % or less, still more preferably 1 mass % or less, and yet still more preferably 0.1 mass % or less on a basis of the total amount (100 mass %) of the solid component in the viscosity index improver (A).

The aforementioned "solid component in the viscosity index improver (A)" means a component in which a diluent oil is eliminated from the viscosity index improver (A) and includes not only the comb-shaped polymer (A1) but also other resin component or by-product not corresponding to the aforementioned comb-shaped polymer (A1).

The content of the comb-shaped polymer (A1) in the viscosity index improver (A) that is used in the embodiment of the present invention is preferably 60 to 100 mass %, more preferably 70 to 100 mass %, still more preferably 80 to 100 mass %, yet still more preferably 90 to 100 mass %, even yet still more preferably 95 to 100 mass %, and even still more preferably 99 to 100 mass % on a basis of the total amount (100 mass %) of the aforementioned solid component in the viscosity index improver (A).

The viscosity index improver (A) that is used in the embodiment of the present invention is one including the comb-shaped polymer (A1) as the resin component. However, in general, taking into consideration handling properties and solubility in the base oil, in many cases, viscosity index improvers are put on the market in a state of a solution in which the solid component including a resin, such as the comb-shaped polymer (A1), etc., is dissolved with a diluent oil, such as a mineral oil, a synthetic oil, etc.

In the case where the viscosity index improver (A) that is used in the embodiment of the present invention is in a form of the aforementioned solution, the solid component concentration of the solution is typically 10 to 50 mass % on a basis of the total amount (100 mass %) of the solution.

In the lubricating oil composition according to the embodiment of the present invention, from the viewpoints of improving the viscosity characteristics and making the fuel saving properties favorable, the content of the viscosity index improver (A) is preferably 0.1 to 20 mass %, more preferably 0.12 to 10 mass %, still more preferably 0.15 to 7 mass %, yet still more preferably 0.2 to 5 mass %, and even yet still more preferably 0.25 to 3 mass % on a basis of the total amount (100 mass %) of the lubricating oil composition.

In the present specification, the aforementioned "content of the viscosity index improver (A)" is a solid component amount including the comb-shaped polymer (A1) and the aforementioned other resin component but not including the mass of the diluent oil.

The "comb-shaped polymer (A1)" which the viscosity index improver (A) that is used in the embodiment of the present invention contains is hereunder described.

<Comb-Shaped Polymer (A1)>

The "comb-shaped polymer" which the viscosity index improver (A) that is used in the present invention contains refers to a polymer having a structure having a large number of trigeminal branch points from which a high-molecular weight side chain comes out in a main chain thereof.

As the comb-shaped polymer (A1) having such a structure, a polymer having at least a constituent unit (I) derived from a macromonomer (I') is preferred. This constituent unit (I) is corresponding to the aforementioned "high-molecular weight side chain".

In the present invention, the aforementioned "macromonomer" means a high-molecular weight monomer having a polymerizable functional group and is preferably a high-molecular weight monomer having a polymerizable functional group in an end thereof.

A number average molecular weight (Mn) of the macromonomer (I') is preferably 200 or more, more preferably 500 or more, still more preferably 600 or more, and yet still more preferably 700 or more, and preferably 200,000 or less, more preferably 100,000 or less, still more preferably 50,000 or less, and yet still more preferably 20,000 or less.

Examples of the polymerizable functional group which the macromonomer (I') has include an acryloyl group ($CH_2{=}CH{-}COO{-}$), a methacryloyl group ($CH_2{=}CCH_3{-}COO{-}$), an ethenyl group ($CH_2{=}CH{-}$), a vinyl ether group ($CH_2{=}CH{-}O{-}$), an allyl group ($CH_2{=}CH{-}CH_2{-}$), an allyl ether group ($CH_2{=}CH{-}CH_2{-}O{-}$), a group represented by $CH_2$═CH—CONH—, a group represented by $CH_2$═$CCH_3$—CONH—, and the like.

The macromonomer (I') may also have at least one selected from repeating units represented by the following general formulae (i) to (iii) in addition to the aforementioned polymerizable functional groups.

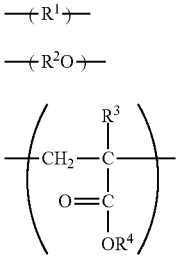

In the general formula (i), $R^1$ represents a linear or branched chain alkylene group having a carbon number of 1 to 10, and specifically, examples thereof include a methylene group, an ethylene group, a 1,2-propylene group, a 1,3-propylene group, a 1,2-butylene group, a 1,3-butylene group, a 1,4-butylene group, a pentylene group, a hexylene group, a heptylene group, an octylene group, a nonylene group, a decylene group, an isopropyl group, an isobutyl group, a 2-ethylhexylene group, and the like.

In the general formula (ii), $R^2$ represents a linear or branched chain alkylene group having a carbon number of 2 to 4, and specifically, examples thereof include an ethylene group, a 1,2-propylene group, a 1,3-propylene group, a 1,2-butylene group, a 1,3-butylene group, a 1,4-butylene group, and the like.

In the general formula (iii), $R^3$ represents a hydrogen atom or a methyl group.

$R^4$ represents a linear or branched chain alkyl group having a carbon number of 1 to 10, and specifically, examples thereof include a methyl group, an ethyl group, a n-propyl group, a n-butyl group, a n-pentyl group, a n-hexyl group, a n-heptyl group, a n-octyl group, a n-nonyl group, a n-decyl group, an isopropyl group, an isobutyl group, a sec-butyl group, a t-butyl group, an isopentyl group, a t-pentyl group, an isohexyl group, a t-hexyl group, an isoheptyl group, a t-heptyl group, a 2-ethylhexyl group, an isooctyl group, an isononyl group, an isodecyl group, and the like.

In the case where the macromonomer (I') has a plurality of repeating units represented by each of the general formulae (i) to $R^1$, $R^2$, $R^3$, and $R^4$ may be each the same as or different from each other.

In the case where the macromonomer (I') is a copolymer having two or more repeating units selected from the general formulae (i) to (iii), the mode of the copolymer may be a block copolymer or may be a random copolymer.

The comb-shaped polymer (A1) that is used in the embodiment of the present invention may be a homopolymer composed of only the constituent unit (I) derived from one kind of the macromonomer (I') or may be a copolymer containing the constituent unit (I) derived from two or more kinds of the macromonomer (I').

In addition, the comb-shaped polymer (A1) that is used in the embodiment of the present invention may also be a copolymer containing the constituent unit (I) derived from the macromonomer (I') as well as a constituent unit (II) derived from other monomer (II') than the macromonomer As a specific structure of the comb-shaped polymer (A1), a copolymer having a side chain containing the constituent unit (I) derived from the macromonomer (I') relative to the main chain including the constituent unit (II) derived from the monomer (II') is preferred.

Examples of the monomer (II') include a monomer (a) represented by the following general formula (a1), an alkyl (meth)acrylate (b), a nitrogen atom-containing vinyl monomer (c), a hydroxy group-containing vinyl monomer (d), a phosphorus atom-containing monomer (e), an aliphatic hydrocarbon vinyl monomer (f), an alicyclic hydrocarbon vinyl monomer (g), an aromatic hydrocarbon vinyl monomer (h), a vinyl ester (i), a vinyl ether (j), a vinyl ketone (k), an epoxy group-containing vinyl monomer (l), a halogen element-containing vinyl monomer (m), an ester of unsaturated polycarboxylic acid (n), a (di)alkyl fumarate (o), a (di)alkyl maleate (p), and the like.

As the monomer the monomers other than the aromatic hydrocarbon vinyl monomer (h) are preferred.

(Monomer (a) Represented by the Following General Formula (a1))

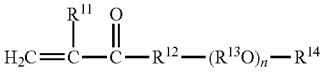

In the general formula (a1), $R^{11}$ represents a hydrogen atom or a methyl group.

$R^{12}$ represents a single bond, a linear or branched alkylene group having a carbon number of 1 to 10, —O—, or —NH—.

$R^{13}$ represents a linear or branched alkylene group having a carbon number of 2 to 4. In addition, n represents an integer of 1 or more (preferably an integer of 1 to 20, and more preferably an integer of 1 to 5). In the case where n is an integer of 2 or more, plural $R^{13}$s may be the same as or different from each other, and furthermore, the $(R^{13}O)_n$ moiety may be either a random bond or a block bond.

$R^{14}$ represents a linear or branched alkyl group having a carbon number of 1 to 60 (preferably 10 to 50, and more preferably 20 to 40).

Specific groups of the aforementioned "linear or branched alkylene group having a carbon number of 1 to 10", "linear or branched alkylene group having a carbon number of 2 to 4", and "linear or branched alkyl group having a carbon number of 1 to 60" include the same groups as those exemplified in the descriptions regarding the aforementioned general formulae (i) to (Alkyl (meth)acrylate (b))

Examples of the alkyl (meth)acrylate (b) include methyl (meth)acrylate, ethyl (meth)acrylate, n-propyl (meth)acrylate, isopropyl (meth)acrylate, n-butyl (meth)acrylate, t-butyl (meth)acrylate, pentyl (meth)acrylate, hexyl (meth)acrylate, 2-ethylhexyl (meth)acrylate, heptyl (meth)acrylate, 2-t-butylheptyl (meth)acrylate, octyl (meth)acrylate, 3-isopropylheptyl (meth)acrylate, and the like.

The carbon number of the alkyl group which the alkyl (meth)acrylate (b) has is preferably 1 to 30, more preferably 1 to 26, and still more preferably 1 to 10.

(Nitrogen Atom-Containing Vinyl Monomer (c))

Examples of the nitrogen atom-containing vinyl monomer (c) include an amide group-containing vinyl monomer (c1), a nitro group-containing vinyl monomer (c2), a primary amino group-containing vinyl monomer (c3), a secondary amino group-containing vinyl monomer (c4), a tertiary amino group-containing vinyl monomer (c5), a nitrile group-containing vinyl monomer (c6), and the like.

Examples of the amide group-containing vinyl monomer (c1) include (meth)acrylamide; monoalkylamino (meth) acrylamides, such as N-methyl (meth)acrylamide, N-ethyl (meth)acrylamide, N-isopropyl (meth)acrylamide, N-n- or isobutyl (meth)acrylamide, etc.; monoalkylaminoalkyl (meth)acrylamides, such as N-methylaminoethyl (meth) acrylamide, N-ethylaminoethyl (meth)acrylamide, N-isopropylamino-n-butyl (meth)acrylamide, N-n- or isobutylamino-n-butyl (meth)acrylamide, etc.; dialkylamino (meth) acrylamides, such as N,N-dimethyl (meth)acrylamide, N,N-diethyl (meth)acrylamide, N,N-diisopropyl (meth) acrylamide, N,N-di-n-butyl (meth)acrylamide, etc.; dialkylaminoalkyl (meth)acrylamides, such as N,N-dimethylaminoethyl (meth)acrylamide, N,N-diethylaminoethyl (meth)acrylamide, N,N-dimethylaminopropyl (meth)acrylamide, N,N-di-n-butylaminobutyl (meth)acrylamide, etc.; N-vinylcarboxylic acid amides, such as N-vinylformamide, N-vinylacetamide, N-vinyl-n- or isopropionylamide, N-vinylhydroxyacetamide, etc.; and the like.

Examples of the nitro group-containing monomer (c2) include 4-nitrostyrene and the like.

Examples of the primary amino group-containing vinyl monomer (c3) include alkenylamines having an alkenyl group having a carbon number of 3 to 6, such as (meth) allylamine, crotylamine, etc.; aminoalkyl (meth)acrylates having an alkyl group having a carbon number of 2 to 6, such as aminoethyl (meth)acrylate, etc.; and the like.

Examples of the secondary amino group-containing vinyl monomer (c4) include monoalkylaminoalkyl (meth)acrylates, such as t-butylaminoethyl (meth)acrylate, methylaminoethyl (meth)acrylate, etc.; dialkenylamines having a carbon number of 6 to 12, such as di(meth)allylamine, etc.; and the like.

Examples of the tertiary amino group-containing vinyl monomer (c5) include dialkylaminoalkyl (meth)acrylates, such as dimethylaminoethyl (meth)acrylate, diethylaminoethyl (meth)acrylate, etc.; alicyclic (meth)acrylates having a nitrogen atom, such as morpholinoethyl (meth)acrylate, etc.; aromatic vinyl monomers, such as diphenylamine (meth) acrylamide, N,N-dimethylaminostyrene, 4-vinylpyridine, 2-vinylpyridine, N-vinylpyrrole, N-vinylpyrrolidone, N-vinylthiopyrrolidone, etc.; hydrochlorides, sulfates, phosphates or lower alkyl (carbon number: 1 to 8) monocarboxylic acid (e.g., acetic acid, propionic acid, etc.) salts thereof; and the like.

Examples of the nitrile group-containing vinyl monomer (c6) include (meth)acrylonitrile and the like.

(Hydroxy Group-Containing Vinyl Monomer (d))

Examples of the hydroxy group-containing vinyl monomer (d) include a hydroxy group-containing vinyl monomer (d1), a polyoxyalkylene chain-containing vinyl monomer (d2), and the like.

Examples of the hydroxy group-containing vinyl monomer (d1) include hydroxy group-containing aromatic vinyl monomers, such as p-hydroxystyrene, etc.; hydroxyalkyl (meth)acrylates having an alkyl group having a carbon number of 2 to 6, such as 2-hydroxyethyl (meth)acrylate, 2- or 3-hydroxypropyl (meth)acrylate, etc.; mono- or di-hydroxyalkyl-substituted (meth)acrylamides having an alkyl group having a carbon number of 1 to 4, such as N,N-dihydroxymethyl (meth)acrylamide, N,N-dihydroxypropyl (meth)acrylamide, N,N-di-2-hydroxybutyl (meth)acrylamide, etc.; vinyl alcohol; alkenols having a carbon number of 3 to 12, such as (meth)allyl alcohol, crotyl alcohol, isocrotyl alcohol, 1-octenol, 1-undecenol, etc.; alkene monools or alkene diols each having a carbon number of 4 to 12, such as 1-buten-3-ol, 2-buten-1-ol, 2-butene-1,4-diol, etc.; hydroxyalkyl alkenyl ethers having an alkyl group having a carbon number of 1 to 6 and an alkenyl group having a carbon number of 3 to 10, such as 2-hydroxyethyl propenyl ether, etc.; alkenyl ethers or (meth)acrylates of a polyhydric alcohol, such as glycerin, pentaerythritol, sorbitol, sorbitan, a sugar, sucrose, etc.; and the like.

Examples of the polyoxyalkylene chain-containing vinyl monomer (d2) include a polyoxyalkylene glycol (carbon number of the alkylene group: 2 to 4, degree of polymerization: 2 to 50), a polyoxyalkylene polyol (polyoxyalkylene ether of the aforementioned polyhydric alcohol (carbon number of the alkylene group: 2 to 4, degree of polymerization: 2 to 100)), a mono(meth)acrylate of an alkyl ether (carbon number: 1 to 4) of a polyoxyalkylene glycol or polyoxyalkylene polyol [e.g., polyethylene glycol (Mn: 100 to 300) mono(meth)acrylate, polypropylene glycol (Mn: 130 to 500) mono(meth)acrylate, methoxypolyethylene glycol (Mn: 110 to 310) (meth)acrylate, lauryl alcohol ethylene oxide adduct (2 to 30 mols) (meth)acrylate, mono(meth) acrylic acid polyoxyethylene (Mn: 150 to 230) sorbitan, etc.], and the like.

(Phosphorus Atom-Containing Monomer (e))

Examples of the phosphorus atom-containing monomer (e) include a phosphate ester group-containing monomer (e1), a phosphono group-containing monomer (e2), and the like.

Examples of the phosphate ester group-containing monomer (e1) include (meth)acryloyloxyalkyl phosphates having an alkyl group having a carbon number of 2 to 4, such as (meth)acryloyloxyethyl phosphate, (meth)acryloyloxyisopropyl phosphate, etc.; alkenyl phosphates having an alkenyl group having a carbon number of 2 to 12, such as vinyl phosphate, allyl phosphate, prop enyl phosphate, isopropenyl phosphate, butenyl phosphate, pentenyl phosphate, octenyl phosphate, decenyl phosphate, dodecenyl phosphate, etc.; and the like.

Examples of the phosphono group-containing monomer (e2) include (meth)acryloyloxyalkyl phosphonates having an alkyl group having a carbon number of 2 to 4, such as (meth)acryloyloxyethyl phosphonate, etc.; alkenyl phosphonates having an alkenyl group having a carbon number of 2 to 12, such as vinyl phosphonate, allyl phosphonate, octenyl phosphonate, etc.; and the like.

(Aliphatic Hydrocarbon Vinyl Monomer (f))

Examples of the aliphatic hydrocarbon vinyl monomer (f) include alkenes having a carbon number of 2 to 20, such as ethylene, propylene, butene, isobutylene, pentene, heptene, diisobutylene, octene, dodecene, octadecene, etc.; alkadienes having a carbon number of 4 to 12, such as butadiene, isoprene, 1,4-pentadiene, 1,6-heptadiene, 1,7-octadiene, etc.; and the like.

The carbon number of the aliphatic hydrocarbon vinyl monomer (f) is preferably 2 to 30, more preferably 2 to 20, and still more preferably 2 to 12.

(Alicyclic Hydrocarbon Vinyl Monomer (g))

Examples of the alicyclic hydrocarbon vinyl monomer (g) include cyclohexene, (di)cyclopentadiene, pinene, limonene, vinylcyclohexene, ethylidene bicycloheptene, and the like.

The carbon number of the alicyclic hydrocarbon vinyl monomer (g) is preferably 3 to 30, more preferably 3 to 20, and still more preferably 3 to 12.

(Aromatic Hydrocarbon Vinyl Monomer (h))

Examples of the aromatic hydrocarbon vinyl monomer (h) include styrene, α-methylstyrene, α-ethylstyrene, vinyltoluene, 2,4-dimethylstyrene, 4-ethylstyrene, 4-isopropylstyrene, 4-butylstyrene, 4-phenylstyrene, 4-cyclohexylstyrene, 4-benzylstyrene, p-methylstyrene, monochlorostyrene, dichlorostyrene, tribromostyrene, tetrabromostyrene, 4-crotylbenzene, indene, 2-vinylnaphthalene, and the like.

The carbon number of the aromatic hydrocarbon vinyl monomer (h) is preferably 8 to 30, more preferably 8 to 20, and still more preferably 8 to 18.

(Vinyl Ester (i))

Examples of the vinyl ester (i) include vinyl esters of a saturated fatty acid having a carbon number of 2 to 12, such as vinyl acetate, vinyl propionate, vinyl butyrate, vinyl octanoate, etc.; and the like.

(Vinyl Ether (j))

Examples of the vinyl ether (j) include alkyl vinyl ethers having a carbon number of 1 to 12, such as methyl vinyl ether, ethyl vinyl ether, propyl vinyl ether, butyl vinyl ether, 2-ethylhexyl vinyl ether, etc.; aryl vinyl ethers having a carbon number of 6 to 12, such as phenyl vinyl ether, etc.; alkoxyalkyl vinyl ethers having a carbon number of 1 to 12, such as vinyl-2-methoxyethyl ether, vinyl-2-butoxyethyl ether, etc.; and the like.

(Vinyl Ketone (k))

Examples of the vinyl ketone (k) include alkyl vinyl ketones having a carbon number of 1 to 8, such as methyl vinyl ketone, ethyl vinyl ketone, etc.; aryl vinyl ketones having a carbon number of 6 to 12, such as phenyl vinyl ketone, etc.; and the like.

(Epoxy Group-Containing Vinyl Monomer (l))

Examples of the epoxy group-containing vinyl monomer (l) include glycidyl (meth)acrylate, glycidyl (meth)allyl ether, and the like.

(Halogen Element-Containing Vinyl Monomer (m))

Examples of the halogen element-containing vinyl monomer (m) include vinyl chloride, vinyl bromide, vinylidene chloride, (meth)allyl chloride, a halogenated styrene (e.g., dichlorostyrene, etc.), and the like.

(Ester of Unsaturated Polycarboxylic Acid (n))

Examples of the ester of unsaturated polycarboxylic acid (n) include an alkyl ester of an unsaturated polycarboxylic acid, a cycloalkyl ester of an unsaturated polycarboxylic acid, an aralkyl ester of an unsaturated polycarboxylic acid, and the like; and examples of the unsaturated carboxylic acid include maleic acid, fumaric acid, itaconic acid, and the like.

((Di)Alkyl Fumarate (o))

Examples of the (di)alkyl fumarate (o) include monomethyl fumarate, dimethyl fumarate, monoethyl fumarate, diethyl fumarate, methylethyl fumarate, monobutyl fumarate, dibutyl fumarate, dipentyl fumarate, dihexyl fumarate, and the like.

((Di)Alkyl Maleate (p))

Examples of the (di)alkyl maleate (p) include monomethyl maleate, dimethyl maleate, monoethyl maleate, diethyl maleate, methylethyl maleate, monobutyl maleate, dibutyl maleate, and the like.

From the viewpoints of improving the viscosity characteristics and making the fuel saving properties favorable, a weight average molecular weight (Mw) of the comb-shaped polymer that is used in the embodiment of the present invention is preferably 1,000 to 1,000,000, more preferably 5,000 to 800,000, still more preferably 10,000 to 650,000, and yet still more preferably 30,000 to 500,000.

From the viewpoints of improving the viscosity characteristics and making the fuel saving properties favorable, a molecular weight distribution (Mw/Mn) of the comb-shaped polymer that is used in the embodiment of the present invention is preferably 8.00 or less, more preferably 7.00 or less, still more preferably 6.00 or less, yet still more preferably 5.60 or less, even yet still more preferably 5.00 or less, and even still more preferably 4.00 or less. As the molecular weight distribution of the comb-shaped polymer is small, there are tendencies that the viscosity characteristics are improved, and the fuel saving properties are improved.

Though a lower limit value of the molecular weight distribution of the comb-shaped polymer is not particularly limited, the molecular weight distribution (Mw/Mn) of the comb-shaped polymer is typically 1.01 or more, preferably 1.05 or more, and more preferably 1.10 or more.

In the lubricating oil composition according to the embodiment of the present invention, from the viewpoints of improving the viscosity characteristics and making the fuel saving properties favorable, the content of the comb-shaped polymer (A1) is preferably 0.1 to 20 mass %, more preferably 0.12 to 10 mass %, still more preferably 0.15 to 7 mass %, yet still more preferably 0.2 to 5 mass %, and even yet still more preferably 0.25 to 3 mass % on a basis of the total amount (100 mass %) of the lubricating oil composition.

In the present specification, the aforementioned "content of the comb-shaped polymer (A1)" does not include the mass of a diluent oil or the like, which is possibly contained together with the comb-shaped polymer.

<Detergent Dispersant (B)>

The lubricating oil composition of the present invention contains a detergent dispersant (B) including an alkali metal borate (B1) and an organometallic compound (B2) containing a metal atom selected from an alkali metal atom and an alkaline earth metal atom.

In the embodiment of the present invention, though the detergent dispersant (B) has only to include the aforementioned components (B1) and (B2), from the viewpoint of improving the detergency, it is preferred that the detergent dispersant (B) further includes at least one alkenylsuccinimide compound (B3) (component (B3)) selected from an alkenylsuccinimide and a boronated alkenylsuccinimide.

As the detergent dispersant (B), other detergent dispersant than the aforementioned components (B1) to (B3) may be contained.

In the embodiment of the present invention, the total content of the aforementioned components (B1) and (B2) in the detergent dispersant (B) is typically 1 to 100 mass %, preferably 1 to 80 mass %, more preferably 2 to 70 mass %, still more preferably 5 to 60 mass %, and yet still more preferably 10 to 50 mass % on a basis of the total amount (100 mass %) of the detergent dispersant (B).

In the embodiment of the present invention, the total content of the aforementioned components (B1) to (B3) in the detergent dispersant (B) is preferably 70 to 100 mass %, more preferably 80 to 100 mass %, still more preferably 90 to 100 mass %, and yet still more preferably 95 to 100 mass % on a basis of the total amount (100 mass %) of the detergent dispersant (B).

In the lubricating oil composition according to the embodiment of the present invention, the content of the detergent dispersant (B) is preferably 0.01 to 20 mass %, more preferably 0.05 to 15 mass %, and still more preferably 0.1 to 10 mass % on a basis of the total amount (100 mass %) of the lubricating oil composition.

[Alkali Metal Borate (B1)]

The lubricating oil composition of the present invention include, as the detergent dispersant (B), an alkali metal borate (B1).

Though as the alkali metal atom included in the alkali metal borate (B1), those mentioned above are exemplified, from the viewpoint of an improvement of detergency at a high temperature, a potassium atom or a sodium atom is preferred, and a potassium atom is more preferred.

The borate is an electrically positive compound (salt) including boron and oxygen and being optionally hydrated. Examples of the borate include a salt of a boric acid ion ($BO_3^{3-}$), a salt of a metaboric acid ion ($BO_2^-$), and the like. The boric acid ion ($BO_3^{3-}$) may form various polymer ions, such as a triboric acid ion ($B_3O_5^-$), a tetraboric acid ion ($B_4O_7^{2-}$), a pentaboric acid ion ($B_5O_8^-$), etc.

Examples of the alkali metal borate (B1) that is used in the embodiment of the present invention include sodium tetraborate, sodium pentaborate, sodium hexaborate, sodium octaborate, sodium diborate, potassium metaborate, potassium triborate, potassium tetraborate, potassium pentaborate, potassium hexaborate, potassium octaborate, and the like, and an alkali metal borate represented by the following general formula (B1-1) is preferred.

$$MO_{1/2}\cdot mBO_{3/2} \qquad \text{General formula (B1-1):}$$

In the general formula (B1-1), M represents an alkali metal atom and is preferably a potassium atom (K) or a sodium atom (Na), and more preferably a potassium atom (K); and m represents the number of 2.5 to 4.5.

The alkali metal borate (B1) that is used in the embodiment of the present invention may be a hydrate.

Examples of the hydrate that may be used as the component (B1) in the embodiment of the present invention include $Na_2B_4O_7\cdot 10H_2O$, $NaBO_2\cdot 4H_2O$, $KB_3O_5\cdot 4H_2O$, $K_2B_4O_7\cdot 5H_2O$, $K_2B_4O_7\cdot 5H_2O$, $K_2B_4O_7\cdot 8H_2O$, $KB_5O_8\cdot 4H_2O$, and the like, and an alkali metal borate hydrate represented by the following general formula (B1-2) is preferred.

$$MO_{1/2}\cdot mBO_{3/2}\sim nH_2O \qquad \text{General formula (B1-2):}$$

In the general formula (B1-2), M and m are the same as those in the aforementioned general formula (B1-1); and n represents the number of 0.5 to 2.4.

A ratio of the boron atom and the alkali metal atom, [(boron atom)/(alkali metal atom)] in the alkali metal borate (B1) that is used in the embodiment of the present invention is preferably 0.1/1 or more, more preferably 0.3/1 or more, still more preferably 0.5/1 or more, and yet still more preferably 0.7/1 or more, and preferably 5/1 or less, more preferably 4.5/1 or less, still more preferably 3.25/1 or less, and yet still more preferably 2.8/1 or less.

The alkali metal borate (B1) that is used in the embodiment of the present invention may be used alone or in combination of any two or more thereof.

Of those, from the viewpoint of an improvement of detergency at a high temperature and the viewpoint of solubility in the base oil, potassium triborate ($KB_3O_5$) and its hydrate ($KB_3O_5\cdot nH_2O$) (n is a number of 0.5 to 2.4) are preferred.

In the lubricating oil composition according to the embodiment of the present invention, the content of the alkali metal borate (B1) in terms of a boron atom is preferably 0.01 to 0.10 mass %, more preferably 0.01 to 0.07 mass %, still more preferably 0.01 to 0.05 mass %, yet still more preferably 0.012 to 0.03 mass %, and especially preferably 0.015 to 0.028 mass % on a basis of the total amount (100 mass %) of the lubricating oil composition.

When the foregoing content is 0.01 mass % or more, a lubricating oil composition with excellent detergency at a high temperature can be provided. On the other hand, when the foregoing content is 0.10 mass % or less, it is easy to disperse the alkali metal borate (B1) in the lubricating oil composition.

The content of the boron atom derived from the alkali metal borate (B1) is preferably 25 mass % or more, more preferably 30 mass % or more, and still more preferably 35 mass % or more, and typically 100 mass % or less, preferably 90 mass % or less, more preferably 80 mass % or less, and still more preferably 70 mass % or less on a basis of the total amount (100 mass %) of the boron atom in the lubricating oil composition according to the embodiment of the present invention.

In the lubricating oil composition of the present invention, from the aforementioned viewpoints, the content of the alkali metal borate (B1) in terms of an alkali metal atom is preferably 0.01 to 0.10 mass %, more preferably 0.01 to 0.07 mass %, still more preferably 0.01 to 0.05 mass %, yet still more preferably 0.012 to 0.04 mass %, and especially preferably 0.015 to 0.035 mass % on a basis of the total amount (100 mass %) of the lubricating oil composition.

A ratio of the content of the comb-shaped polymer (A1) and the content of the alkali metal borate (B1) in terms of a boron atom, [(A1)/(B1)] is preferably 12/1 to 100/1, more preferably 15/1 to 85/1, still more preferably 20/1 to 70/1, and yet still more preferably 25/1 to 60/1.

When the foregoing ratio is 12/1 or more, the viscosity characteristics can be made favorable, and the fuel saving properties can be improved. On the other hand, where the foregoing ratio is 100/1 or less, a lubricating oil composition with improved detergency can be provided.

In the present specification, the aforementioned "content of the component (B1) in terms of a boron atom" is the same as the "content of the boron atom derived from the component (B1)".

From the same viewpoints as those mentioned above, a ratio of the content of the comb-shaped polymer (A1) and the content of the alkali metal borate (B1) in terms of an alkali metal atom, [(A1)/(B1)] is preferably 12/1 to 100/1, more preferably 15/1 to 85/1, still more preferably 20/1 to 70/1, and yet still more preferably 25/1 to 60/1.

In the present specification, the aforementioned "content of the component (B1) in terms of an alkali metal atom" is the same as the "content of the alkali metal atom derived from the component (B1)".

[Organometallic Compound (B2)]

The lubricating oil composition of the present invention include, as the detergent dispersant (B), an organometallic compound (B2) containing a metal atom selected from an alkali metal atom and an alkaline earth metal atom.

In the present invention, the "organometallic compound" means a compound including at least the aforementioned metal atom, a carbon atom, and a hydrogen atom, and the foregoing compound may further contain an oxygen atom, a sulfur atom, a nitrogen atom, and so on.

Examples of the metal atom included in the organometallic compound (B2) that is used in the embodiment of the present invention include the aforementioned alkali metal atoms and alkaline earth metal atoms. From the viewpoint of an improvement of detergency at a high temperature, a sodium atom, a calcium atom, a magnesium atom, or a barium atom is preferred; a calcium atom or a magnesium atom is more preferred; and a calcium atom is still more preferred.

As the organometallic compound (B2) that is used in the embodiment of the present invention, at least one selected from a metal salicylate, a metal phenate, and a metal sulfonate, each containing a metal atom selected from an alkali metal atom and an alkaline earth metal atom, is preferred; a mixture of a metal sulfonate and at least one selected from a metal salicylate and a metal phenate is more preferred; and a mixture of a metal sulfonate and a metal salicylate is still more preferred.

As the metal salicylate, a compound represented by the following general formula (B2-1) is preferred; as the metal phenate, a compound represented by the following general formula (B2-2) is preferred; and as the metal sulfonate, a compound represented by the following general formula (B2-3) is preferred.

(B2-1)

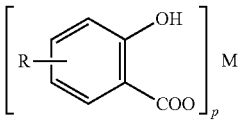

(B2-2)

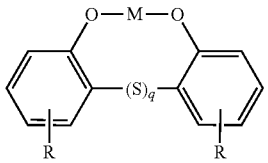

(B2-3)

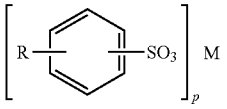

In the general formulae (B2-1) to (B2-3), M is a metal atom selected from an alkali metal atom and an alkaline earth metal atom, and preferably a sodium atom (Na), a calcium atom (Ca), a magnesium atom (Mg), or a barium atom (Ba), more preferably a calcium atom (Ca) or a magnesium atom (Mg), and still more preferably a calcium atom (Ca). p is a valence of M, and 1 or 2. q is an integer of 0 or more, and preferably an integer of 0 to 3. R is a hydrogen atom or a hydrocarbon group having a carbon number of 1 to 18.

Examples of the hydrocarbon group that may be selected as R include an alkyl group having a carbon number of 1 to 18, an alkenyl group having a carbon number of 1 to 18, a cycloalkyl group having a ring-forming carbon number of 3 to 18, an aryl group having a ring-forming carbon number of 6 to 18, an alkylaryl group having a carbon number of 7 to 18, an arylalkyl group having a carbon number of 7 to 18, and the like.

Though the organometallic compound (B2) that is used in the embodiment of the present invention may be any of a neutral salt, a basic salt, an overbased salt, and a mixture thereof, it is preferably a mixture of a neutral salt and at least one selected from a basic salt and an overbased salt.

In the foregoing mixture, a ratio of the neutral salt and at least one selected from a basic salt and an overbased salt, [(neutral salt)/(basic salt and/or overbased salt)] is preferably 1/99 to 99/1, more preferably 10/99 to 90/10, and still more preferably 20/80 to 80/20.

In the case where the organometallic compound (B2) that is used in the embodiment of the present invention is a neutral salt, a base number of the foregoing neutral salt is preferably 0 to 30 mgKOH/g, more preferably 0 to 25 mgKOH/g, and still more preferably 0 to 20 mgKOH/g.

In the case where the organometallic compound (B2) that is used in the embodiment of the present invention is a basic salt or an overbased salt, a base number of the foregoing basic salt or overbased salt is preferably 100 to 600 mgKOH/g, more preferably 120 to 550 mgKOH/g, still more preferably 160 to 500 mgKOH/g, and yet still more preferably 200 to 450 mgKOH/g.

In the present specification, the "base number" means a base number as measured by the perchloric acid method in conformity with JIS K2501, Section 7: "Petroleum products and lubricating oils-neutralization number test method".

The organometallic compound (B2) that is used in the embodiment of the present invention may be used alone or in combination of any two or more thereof.

Of those, from the viewpoint of an improvement of detergency at a high temperature and the viewpoint of solubility in the base oil, a mixture of a metal sulfonate that is the neutral salt and at least one basic salt or overbased salt selected from a metal salicylate and a metal phenate is preferred, and a mixture of a metal sulfonate that is the neutral salt and a metal salicylate that is the basic salt or overbased salt is more preferred.

In the lubricating oil composition according to the embodiment of the present invention, the content of the organometallic compound (B2) in terms of a metal atom selected from an alkali metal atom and an alkaline earth metal atom is preferably 0.01 to 0.20 mass %, more preferably 0.02 to 0.18 mass %, still more preferably 0.03 to 0.15 mass %, and yet still more preferably 0.05 to 0.13 mass % on a basis of the total amount (100 mass %) of the lubricating oil composition.

When the foregoing content is 0.01 mass % or more, a lubricating oil composition with excellent detergency at a high temperature can be provided. On the other hand, when the foregoing content is 0.20 mass % or less, a lubricating oil composition with favorable LSPI-preventing properties can be provided.

In the lubricating oil composition according to the embodiment of the present invention, a ratio of the content of the organometallic compound (B2) in terms of a metal atom selected from an alkali metal atom and an alkaline earth metal atom and the content of the alkali metal borate (B1) in terms of a boron atom, [(32)/(B1)] is preferably 1/1 to 15/1, more preferably 2/1 to 12/1, and still more preferably 3/1 to 10/1 from the viewpoint of providing a lubricating oil composition with excellent detergency at a high temperature and favorable LSPI-preventing properties; yet still more preferably 6/1 to 10/1 from the viewpoint of more improving the detergency; and even yet still more preferably 3/1 to 5.5/1 from the viewpoint of more improving the LSPI-preventing properties.

In the present invention, the aforementioned "content of the component (B2) in terms of a metal atom selected from an alkali metal atom and an alkaline earth metal atom" is the same as the "content of the metal atom selected from an alkali metal atom and an alkaline earth metal atom as derived from the component (B2)".

[Alkenylsuccinimide Compound (B3)]

From the viewpoint of more improving the detergency at a high temperature, it is preferred that the lubricating oil composition according to the embodiment of the present invention includes, as the detergent dispersant (B), at least one alkenylsuccinimide compound (B3) selected from an alkenylsuccinimide and a boronated alkenylsuccinimide.

In the embodiment of the present invention, the component (B3) is a compound including a monoimide structure or a bisimide structure.

Examples of the alkenylsuccinimide include an alkenylsuccinimide monoimide represented by the following general formula (B3-1) and an alkenylsuccinimide bisimide represented by the following general formula (B3-2).

Examples of the boronated alkenylsuccinimide include a boronated compound of an alkenylsuccinimide represented by the following general formula (B3-1) or (B3-2).

(B3-1)

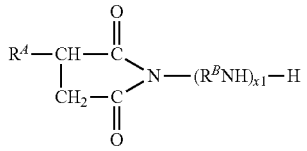

(B3-2)

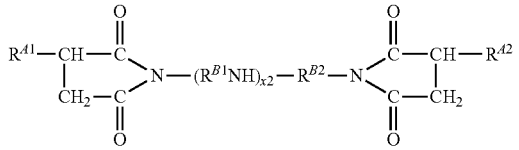

In the general formulae (B3-1) and (B3-2), $R^{A}A$, $R^{A1}$, and $R^{A2}$ are each independently an alkenyl group having a weight average molecular weight (Mw) of 500 to 3,000 (preferably 1,000 to 3,000).

$R^{B}$, $R^{B1}$, and $R^{B2}$ are each independently an alkylene group having a carbon number of 2 to 5.

x1 is an integer of 1 to 10, preferably an integer of 2 to 5, and more preferably 3 or 4.

x2 is an integer of 0 to 10, preferably an integer of 1 to 4, and more preferably 2 or 3.

Examples of the alkenyl group that may be selected as $R^{A}$, $R^{A1}$, and $R^{A2}$ include a polybutenyl group, a polyisobutenyl group, an ethylene-propylene copolymer, and the like. Of those, a polybutenyl group or a polyisobutenyl group is preferred.

The alkenylsuccinimide can be, for example, produced by allowing an alkenylsuccinic anhydride that is obtained through a reaction of a polyolefin and maleic anhydride to react with a polyamine.

Examples of the polyolefin include polymers that are obtained through polymerization of one or two or more selected from an α-olefin having a carbon number of 2 to 8, and a copolymer of isobutene and 1-butene is preferred.

Examples of the polyamine include single diamines, such as ethylenediamine, propylenediamine, butylenediamine, pentylenediamine, etc.; polyalkylenepolyamines, such as diethylenetriamine, triethylenetetramine, tetraethylenepentamine, pentaethylenehexamine, di(methylethylene)triamine, dibutylenetriamine, tributylenetetramine, pentapentylenehexamine, etc.; piperazine derivatives, such as aminoethylpiperazine, etc.; and the like.

The boronated alkenylsuccinimide can be, for example, produced by allowing an alkenylsuccinic anhydride that is obtained through a reaction of the aforementioned polyolefin and maleic anhydride to react with the aforementioned polyamine and a boron compound.

Examples of the boron compound include boron oxide, a boron halide, boric acid, boric anhydride, a boric acid ester, an ammonium salt of boric acid, and the like.

In the embodiment of the present invention, from the viewpoint of improving the detergency at a high temperature, a ratio of the boron atom and the nitrogen atom constituting the boronated alkenylsuccinimide, [B/N] is preferably 0.5 or more, more preferably 0.6 or more, still more preferably 0.8 or more, and yet still more preferably 0.9 or more.

In the lubricating oil composition according to the embodiment of the present invention, the content of the alkenylsuccinimide compound (B3) in terms of a nitrogen atom is preferably 0.001 to 0.30 mass %, more preferably 0.005 to 0.25 mass %, still more preferably 0.01 to 0.20 mass %, yet still more preferably 0.02 to 0.20 mass %, even yet still more preferably 0.04 to 0.16 mass %, even still more preferably 0.05 to 0.15 mass %, even still more further preferably 0.06 to 0.14 mass %, and especially preferably 0.07 to 0.12 mass % on a basis of the total amount (100 mass %) of the lubricating oil composition.

When the foregoing content is 0.001 mass % or more, a lubricating oil composition with more improved detergency at a high temperature can be provided. On the other hand, when the foregoing content is 0.30 mass % or less, the kinematic viscosity of the lubricating oil composition is easily regulated low, and the fuel saving properties can be improved.

A ratio of the content of the comb-shaped polymer (A1) and the content of the alkenylsuccinimide compound (B3) in terms of a boron atom, [(A1)/(B3)] is preferably 1.6/1 to 30/1, more preferably 1.8/1 to 20/1, still more preferably 2.0/1 to 16/1, and yet still more preferably 3.0/1 to 10/1.

When the foregoing ratio is 1.6/1 or more, the viscosity characteristics can be made favorable, and the fuel saving properties can be improved. On the other hand, where the foregoing ratio is 30/1 or less, a lubricating oil composition with more improved detergency can be provided.

In the present specification, the aforementioned "content of the component (B3) in terms of a boron atom" is the same as the "content of the boron atom derived from the component (B3)".

In the lubricating oil composition according to the embodiment of the present invention, it is preferred that the component (B3) includes both the alkenylsuccinimide and the boronated alkenylsuccinimide.

A ratio of the content (i) of the alkenylsuccinimide in terms of a nitrogen atom and the content (ii) of the boronated alkenylsuccinimide in terms of a boron atom, [(i)/(ii)] is preferably 1/5 to 20/1, more preferably 1/2 to 15/1, still more preferably 1/1 to 10/1, and yet still more preferably 2.5/1 to 6/1.

In the lubricating oil composition according to the embodiment of the present invention, the content of the boronated alkenylsuccinimide included as the component (B3) in terms of a boron atom is preferably 0.001 to 0.015 mass %, more preferably 0.001 to 0.10 mass %, still more preferably 0.003 to 0.07 mass %, yet still more preferably 0.005 to 0.05 mass %, and especially preferably 0.01 to 0.04 mass % on a basis of the total amount (100 mass %) of the lubricating oil composition.

The content of the boronated alkenylsuccinimide in terms of a nitrogen atom is preferably 0.001 to 0.10 mass %, more preferably 0.003 to 0.07 mass %, still more preferably 0.005 to 0.05 mass %, and yet still more preferably 0.01 to 0.04 mass % on a basis of the total amount (100 mass %) of the lubricating oil composition.

<Friction Modifier (C)>

The lubricating oil composition of the present invention contains a friction modifier including a molybdenum-containing friction modifier. By containing the molybdenum-containing friction modifier, a lubricating oil composition with improved anti-wear characteristics and excellent fuel saving properties can be provided.

The molybdenum-containing friction modifier that is used in the embodiment of the present invention is not particularly limited so long as it is a compound containing molybdenum (Mo) in a molecule thereof, and examples thereof include molybdenum dithiocarbamate (MoDTC), molybdenum dithiophosphate (MoDTP), an amine salt of molybdic acid, and the like.

Of those, molybdenum dithiocarbamate (MoDTC) or molybdenum dithiophosphate (MoDTP) is preferred.

As the molybdenum dithiocarbamate (MoDTC), a compound represented by the following general formula (C-1) is preferred. As the molybdenum dithiophosphate (MoDTP), a compound represented by the following general formula (C-2) is preferred.

(C-1)

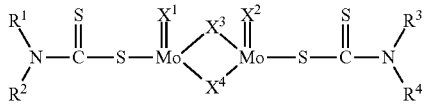

(C-2)

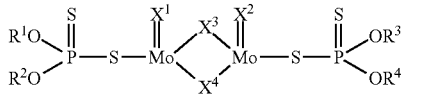

In the general formulae (C-1) and (C-2), $R^1$ to $R^4$ each independently represent a hydrocarbon group having a carbon number of 5 to 18 (preferably 5 to 16, and more preferably 5 to 12) and may be the same as or different from each other.

$X^1$ to $X^4$ each independently represent an oxygen atom or a sulfur atom and may be the same as or different from each other.

From the viewpoint of improving the solubility in the base oil, in the general formulae (C-1) and (C-2), a molar ratio of the sulfur atom and the oxygen atom in $X^1$ to $X^4$, [(sulfur atom)/(oxygen atom)] is preferably 1/3 to 3/1, and more preferably 1.5/2.5 to 3/1.

Examples of the hydrocarbon group that may be selected as $R^1$ to $R^4$ include an alkyl group having a carbon number of 5 to 18, such as a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, etc.; an alkenyl group having a carbon number of 5 to 18, such as an octenyl group, a nonenyl group, a decenyl group, an undecenyl group, a dodecenyl group, a tridecenyl group, a tetradecenyl group, a pentadecenyl group, etc.; a cycloalkyl group having a carbon number of 5 to 18, such as a cyclohexyl group, a dimethylcyclohexyl group, an ethylcyclohexyl group, a methylcyclohexylmethyl group, a cyclohexylethyl group, a propylcyclohexyl group, a butylcyclohexyl group, a heptylcyclohexyl group, etc.; an aryl group having a carbon number of 6 to 18, such as a phenyl group, a naphthyl group, an anthracenyl group, a biphenyl group, a terphenyl group, etc.; an alkylaryl group, such as a tolyl group, a dimethylphenyl group, a butylphenyl group, a nonylphenyl group, a methylbenzyl group, a dimethylnaphthyl group, etc.; an arylalkyl group having a carbon number of 7 to 18 carbon atoms, such as a phenylmethyl group, a phenylethyl group, a diphenylmethyl group, etc.; and the like.

In the lubricating oil composition according to the embodiment of the present invention, the content of the molybdenum-containing friction modifier in terms of a molybdenum atom is preferably 0.01 to 0.15 mass %, more preferably 0.012 to 0.10 mass %, still more preferably 0.015 to 0.08 mass %, yet still more preferably 0.02 to 0.08 mass %, and especially preferably 0.05 to 0.08 on a basis of the total amount (100 mass %) of the lubricating oil composition.

When the foregoing content is 0.01 mass % or more, a lubricating oil composition with improved anti-wear characteristics and excellent fuel saving properties can be provided. On the other hand, when the foregoing content is 0.15 mass % or less, worsening of the detergency can be suppressed.

The lubricating oil composition according to the embodiment of the present invention may contain, as the friction modifier (C), other friction modifier than the molybdenum-containing friction modifier.

Examples of the other friction modifier include an ashless friction modifier having at least one alkyl group or alkenyl group having a carbon number of 6 to 30, especially a linear alkyl group or linear alkenyl group having a carbon number of 6 to 30 in a molecule thereof, such as an aliphatic amine, a fatty acid ester, a fatty acid amide, a fatty acid, an aliphatic alcohol, an aliphatic ether, etc.; and the like.

In the embodiment of the present invention, the content of the molybdenum-containing friction modifier in the friction modifier (C) is preferably 60 to 100 mass %, more preferably 70 to 100 mass %, still more preferably 80 to 100 mass %, and yet still more preferably 90 to 100 mass % on a basis of the total amount (100 mass %) of the friction modifier (C).

In the embodiment of the present invention, the content of the friction modifier (C) is preferably 0.01 to 3.0 mass %, more preferably 0.01 to 2.0 mass %, and still more preferably 0.01 to 1.0 mass % on a basis of the total amount (100 mass %) of the lubricating oil composition.

<General-Purpose Additive>

The lubricating oil composition according to the embodiment of the present invention may contain a general-purpose additive constituted of a compound not corresponding to the components (A) to (C), if desired within the range where the effects of the present invention are not impaired.

Examples of the general-purpose additive include an anti-wear agent, an extreme pressure agent, an antioxidant, a pour-point depressant, a rust inhibitor, a metal deactivator, an anti-foaming agent, and the like.

Though the content of each of these general-purpose additives can be properly regulated within the range where the object of the present invention is not impaired, it is typically 0.001 to 10 mass %, and preferably 0.005 to 5 mass % on a basis of the total amount (100 mass %) of the lubricating oil composition.

In the lubricating oil composition according to the embodiment of the present invention, the total content of these general-purpose additives is preferably 20 mass % or less, more preferably 10 mass % or less, still more preferably 5 mass % or less, and yet still more preferably 2 mass % or less on a basis of the total amount (100 mass %) of the lubricating oil composition.

Examples of the anti-wear agent or the extreme pressure agent include sulfur-containing compounds, such as zinc dialkyldithiophosphate (ZnDTP), zinc phosphate, zinc dithiocarbamate, molybdenum dithiocarbamate, molybdenum dithiophosphate, disulfides, sulfurized olefins, sulfurized oils and fats, sulfurized esters, thiocarbonates, thiocarbamates, polysulfides, etc.; phosphorus-containing compounds, such as phosphite esters, phosphate esters, phosphonate esters, and amine salts or metal salts thereof, etc.; and sulfur- and phosphorus-containing anti-wear agents, such as thiophosphite esters, thiophosphate esters, thiophosphonate esters, and amine salts or metal salts thereof, etc.

Of those, zinc dialkyldithiophosphate (ZnDTP) is preferred. In the case where the lubricating oil composition according to the embodiment of the present invention includes ZnDTP, the content of ZnDTP in terms of a phosphorus atom is preferably 0.01 to 0.2 mass %, more preferably 0.02 to 0.15 mass %, still more preferably 0.03 to 0.12 mass %, and yet still more preferably 0.03 to 0.10 mass % on a basis of the total amount (100 mass %) of the lubricating oil composition.

Examples of the antioxidant include phenolic antioxidants, such as a bisphenol antioxidant, an ester group-containing phenol antioxidant, etc.; amine type antioxidants, such as a diphenylamine antioxidant, etc.; and the like. The amine antioxidant may also be a molybdenum amine antioxidant not corresponding to the aforementioned component (C).

Examples of the pour-point depressant include an ethylene-vinyl acetate copolymer, a condensate of a chlorinated paraffin and naphthalene, a condensate of a chlorinated paraffin and phenol, a polymethacrylate, a polyalkylstyrene, and the like.

Examples of the rust inhibitor include a petroleum sulfonate, an alkylbenzene sulfonate, dinonylnaphthalene sulfonate, an alkenylsuccinic ester, a polyhydric alcohol ester, and the like.

Examples of the metal deactivator include a benzotriazole compound, a tolyltriazole compound, a thiadiazole compound, an imidazole compound, a pyrimidine compound, and the like.

Examples of the anti-foaming agent include silicone oil, fluorosilicone oil, a fluoroalkyl ether, and the like.

Examples of the extreme pressure agent include sulfur type extreme pressure agents, such as a sulfide, a sulfoxide, a sulfone, a thiophosphinate, etc.; halogen type extreme pressure agents, such as a chlorinated hydrocarbon, etc.; organometallic extreme pressure agents; and the like.

[Various Properties of Lubricating Oil Composition]

The content of the boron atom in the lubricating oil composition according to the embodiment of the present invention is preferably 0.01 to 0.20 mass %, more preferably 0.012 to 0.15 mass %, still more preferably 0.015 to 0.10 mass %, and yet still more preferably 0.02 to 0.07 mass % on a basis of the total amount (100 mass %) of the lubricating oil composition.

The content of the potassium atom in the lubricating oil composition according to the embodiment of the present invention is preferably 0.01 to 0.10 mass %, more preferably 0.01 to 0.07 mass %, still more preferably 0.01 to 0.05 mass %, and yet still more preferably 0.012 to 0.03 mass % on a basis of the total amount (100 mass %) of the lubricating oil composition.

The content of the nitrogen atom in the lubricating oil composition according to the embodiment of the present invention is preferably 0.001 to 0.30 mass %, more preferably 0.005 to 0.25 mass %, still more preferably 0.01 to 0.20 mass %, and yet still more preferably 0.05 to 0.15 mass % on a basis of the total amount (100 mass %) of the lubricating oil composition.

The content of the molybdenum atom in the lubricating oil composition according to the embodiment of the present invention is preferably 0.01 to 0.15 mass %, more preferably 0.012 to 0.10 mass %, still more preferably 0.015 to 0.08 mass %, and yet still more preferably 0.02 to 0.06 mass % on a basis of the total amount (100 mass %) of the lubricating oil composition.

The content of the phosphorus atom in the lubricating oil composition according to the embodiment of the present invention is preferably 0.01 to 0.2 mass %, more preferably 0.02 to 0.15 mass %, and still more preferably 0.03 to 0.10 mass % on a basis of the total amount (100 mass %) of the lubricating oil composition.

A kinematic viscosity at 40° C. of the lubricating oil composition according to the embodiment of the present invention is preferably 10 to 100 $mm^2/s$, more preferably 10 to 70 $mm^2/s$, and still more preferably 10 to 40 $mm^2/s$.

A kinematic viscosity at 100° C. of the lubricating oil composition according to the embodiment of the present invention is preferably 3 to 20 $mm^2/s$, more preferably 3 to 10 $mm^2/s$, and still more preferably 5 to 8 $mm^2/s$.

A viscosity index of the lubricating oil composition according to the embodiment of the present invention is preferably 160 or more, more preferably 170 or more, and still more preferably 180 or more.

An HTHS viscosity at 150° C. of the lubricating oil composition according to the embodiment of the present invention is preferably 1.6 to 3.2 mPa·s, more preferably 1.7 to 3.0 mPa·s, still more preferably 1.8 to 2.8 mPa·s, and yet still more preferably 2.0 to 2.7 mPa·s.

When the foregoing HTHS viscosity at 150° C. is 1.6 mPa·s or more, the lubricating performance can be made favorable. On the other hand, when the foregoing HTHS viscosity at 150° C. is 3.2 mPa·s or less, not only the viscosity characteristics can be made favorable, but also the fuel saving properties can be made favorable.

The HTHS viscosity at 150° C. can also be assumed as a viscosity in a high-temperature region at the time of high-speed operation of an engine. So long as the HTHS viscosity at 150° C. falls within the aforementioned range, it may be said that the lubricating oil composition is favorable in various properties, such as a viscosity in a high-temperature region assuming the time of high-speed operation of an engine, etc.

In the present specification, the "HTHS viscosity at 150° C." is a value of a high temperature high shear viscosity at 150° C. as measured in conformity with ASTM D4741, and specifically, it means a value as measured by the measurement method described in the Examples.

A coefficient of friction of the lubricating oil composition according to the embodiment of the present invention as measured using an HFRR tester is preferably 0.12 or less, more preferably 0.10 or less, still more preferably 0.06 or less, and yet still more preferably 0.05 or less.

A maximum value of a heat flow of the lubricating oil composition according to the embodiment of the present invention as measured using a high-pressure differential scanning calorimeter is preferably 340 mW or less, more preferably 339 mW or less, and still more preferably 337 mW.

In the present specification, the coefficient of friction and the maximum of heat flow of the lubricating oil composition mean values as measured by the measurement methods described in the Examples.

[Application of Lubricating Oil Composition]

The lubricating oil composition of the present invention has excellent detergency, fuel saving properties, and LSPI-preventing properties.

Therefore, an engine filled with the lubricating oil composition of the present invention may become excellent in fuel saving properties. Though the foregoing engine is not particularly limited, it is preferably an engine for automobile, and more preferably a direct-injection supercharged engine.

Therefore, the present invention also provides a use method of a lubricating oil composition including using the aforementioned lubricating oil composition of the present invention for direct-injection supercharged gasoline engines.

Though the lubricating oil composition according to the embodiment of the present invention is suitably applied for direct-injection supercharged gasoline engines, it may also be adopted for other applications.

Examples of other applications which may be considered with respect to the lubricating oil composition according to the embodiment of the present invention include a power stirring oil, an automatic transmission fluid (ATF), a continuously variable transmission fluid (CVTF), a hydraulic oil, a turbine oil, a compressor oil, a lubricating oil for machine tool, a cutting oil, a gear oil, a fluid bearing oil, a rolling bearing oil, and the like.

[Method for Producing Lubricating Oil Composition]

The present invention also provides a method for producing a lubricating oil composition including the following step (I).

Step (I): A step of blending a base oil with a viscosity index improver (A) including a comb-shaped polymer (A1), a detergent dispersant (B) including an alkali metal borate (B1) and an organometallic compound (B2) containing a metal atom selected from an alkali metal atom and an alkaline earth metal atom, and a friction modifier (C) including a molybdenum-containing friction modifier, thereby preparing a lubricating oil composition such that the total content of an alkali metal atom and an alkaline earth metal atom is 2,000 mass ppm or less, or the content of a calcium atom is 1,900 mass ppm or less.

In the step (I), the base oil and the components (A) to (C) to be blended are those as described above, and the suitable components and contents of the respective components are also the same.

In addition, in the present step, the aforementioned general-purpose additives other than the base oil and the components (A) to (C), and the like may also be blended.

The component (A) may be blended in a form of a solution having the resin component including the comb-shaped polymer (A1) dissolved in a diluent oil. A solid component concentration of the solution is typically 10 to 50 mass %.

In the embodiment of the present invention, in the case where the component (A) is blended in a form of a solution of the viscosity index improver (A) having a solid component concentration of 10 to 50 mass %, the blending amount of the solution is preferably 0.1 to 30 mass %, more preferably 1 to 25 mass %, and still more preferably 2 to 20 mass % relative to the total amount (100 mass %) of the lubricating oil composition.

Besides the component (A), the components (B) to (C) and the aforementioned general-purpose additives may also be blended after adding a diluent oil and so on to form a solution (dispersion).

It is preferred that after blending the respective components, the resulting blend is stirred and uniformly dispersed by a known method.

Lubricating oil compositions obtained in the case where after blending the respective components, a part of the components denatures, or two of the components react with each other to form another component, fall within the technical scope of the present invention.

EXAMPLES

The present invention is hereunder described in more detail by reference to Examples, but it should be construed that the present invention is by no means limited by these Examples. Contents of respective atoms of each of the lubricating oil compositions prepared in the Examples and Comparative Examples and an HTHS viscosity at 150° C. of each of the lubricating oil compositions were measured and evaluated by the following methods.

[Contents of Respective Atoms of Lubricating Oil Composition]

<Contents of Boron Atom, Calcium Atom, Potassium Atom, Molybdenum Atom, and Phosphorus Atom>

The measurement was performed in conformity with JPI-5S-38-92.

<Content of Nitrogen Atom>

The measurement was measured in conformity with JIS K2609.

[HTHS Viscosity (High Temperature High Shear Viscosity) at 150° C.]

A viscosity after shearing a lubricating oil composition as a measuring object at 150° C. and at a shear rate of $10^6$/s was measured in conformity with ASTM D4741.

A base oil and various additives used for preparation of each of lubricating oil compositions prepared in the following Examples and Comparative Examples are as follows.

<Base Oil>

Mineral oil (Group III): A mineral oil classified into Group III of the API Base Oil Category, kinematic viscosity at 100° C.=4.067 $mm^2$/s, viscosity index=131.

Synthetic oil (PAO): A synthetic oil made of a poly-α-olefin, kinematic viscosity at 100° C.=5.1 $mm^2$/s, viscosity index=143.

<Viscosity Index Improver>

Viscosity index improver (1): A trade name: "Viscoplex 3-201", manufactured by Evonik; a viscosity index improver including, as a main resin component, a comb-shaped polymer (Mw=420,000, Mw/Mn=5.92) having at least a constituent unit derived from a macromonomer having an Mn of 500 or more, and having a resin component concentration of 19 mass %.

Viscosity index improver (2): A trade name: "Viscoplex 3-220", manufactured by Evonik; a viscosity index improver including, as a main resin component, a comb-shaped polymer (Mw=450,000, Mw/Mn=3.75) having at least a constituent unit derived from a macromonomer having an Mn of 500 or more, and having a resin component concentration of 42 mass %.

Viscosity index improver (3): A trade name: "ACLUBE V-5110", manufactured by Sanyo Chemical Industries, Ltd.; a viscosity index improver including, as a main resin component, a polymethacrylate (PMA, Mw=500,000) and having a resin component concentration of 19 mass %.

Viscosity index improver (4): A trade name: "PARATONE 8451", manufactured by Chevron Oronite Company LLC; a viscosity index improver including, as a main resin component, an olefin copolymer (OCP, Mw=330,000) and having a resin component concentration of 6 mass %.

Viscosity index improver (5): A trade name: "Infineum SV261", manufactured by Infineum International Ltd.; a viscosity index improver including, as a main resin component, a star-shaped polymer (Mw=610,000) and having a resin component concentration of 11 mass %. (Here, the "star-shaped polymer" means a polymer which is a kind of branched polymer and has a structure in which three or more chain polymers are bonded at one point, and is structurally different from the aforementioned comb-shaped polymer.)

<Detergent Dispersant>

Potassium triborate: A dispersion of potassium triborate hydrate (boron atom content: 6.8 mass %, potassium atom content: 8.3 mass %), which is corresponding to the aforementioned "component (B1)".

Calcium-containing detergent: A mixture of neutral calcium sulfonate (calcium atom content: 2.2 mass %, base number: 17 mgKOH/g) and overbased calcium salicylate (calcium atom content: 12.1 mass %, base number: 350 mgKOH/g), which is corresponding to the aforementioned "component (B2)".

Alkenylsuccinimide: Corresponding to the aforementioned "component (B3)" (nitrogen atom content: 1.0 mass %)

Boronated alkenylsuccinimide: Corresponding to the foregoing "component (B3)" (boron atom content: 1.3 mass %, nitrogen atom content: 1.2 mass %).

<Friction Modifier>

MoDTC: Molybdenum dithiocarbamate (Mo atom content: 10 mass %, sulfur atom content: 11.5 mass %)

<Anti-Wear Agent>

ZnDTP: Zinc dialkyldithiophosphate (phosphorus atom content: 7.5 mass %, zinc atom content: 8.5 mass %, sulfur atom content: 15.0 mass %)

[Evaluation of Detergency of Lubricating Oil Composition]

Examples 1 to 14 and Comparative Examples 1 to 5

The base oil and the various additives of the kind and blending amounts shown in Table 1 were blended to prepare lubricating oil compositions so as to have an HTHS viscosity at 150° C. of 2.6 mPa·s.

While the expression of the content of the mineral oil in Tables 1 to 5 is described as "Regulated", this means that the content of the mineral oil was properly regulated within the range of 75 to 95 mass %.

These prepared lubricating oil compositions were subjected to a hot tube test at 300° C. according to the following method. The results are shown in Table 1.

In addition, the lubricating oil compositions of Example 2 and Comparative Example 5 described in Table 1 (also described in Table 2) were also subjected to a Sequence IIIG test according to the following method. The results are shown in Table 2.

<Hot Tube Test (300° C.)>

As a lubricating oil composition for test, a mixed oil obtained by blending the aforementioned respective lubricating oil composition (fresh oil) within 5 mass % of a biofuel (a fuel obtained through transesterification of rapeseed oil with methyl alcohol) was used while assuming a mixing portion of the fuel and the lubricating oil within an internal combustion engine.

The measurement was performed by setting the test temperature to 300° C. and making other conditions in conformity with those of JPI-5S-55-99. Conforming to JPI-5S-55-99, a lacquer attached to a test tube after the test was evaluated between Point 0 (black) and Point 10 (colorless) and evaluated on 11 grades. It is meant that as the numerical value is large, a deposit is less, and the detergency is favorable. As for the grade point, though Points 6 or more are evaluated to be acceptable, Points 7 or more are preferred, and Points 8 or more are more preferred.

TABLE 1

| | | | | Base of content | Example 1 | 2 | 3 | 4 | 5 | 6 | 7 |
|---|---|---|---|---|---|---|---|---|---|---|---|
| Composition (mass %) | Base oil | — | Mineral oil (Group III) | Total amount of composition | Reg.** | Reg.** | Reg.** | Reg.** | Reg.** | Reg.** | Reg.** |
| | | | Synthetic oil (PAO) | | 10.0 | 10.0 | 10.0 | 10.0 | — | 10.0 | 10.0 |
| | Viscosity index improver | (A) | Viscosity index improver (1) (containing 19 wt % of comb-shaped polymer) | | 3.2 | 3.2 | 3.2 | — | 3.2 | 3.2 | 3.2 |
| | | | Viscosity index improver (2) (containing 42 wt % of comb-shaped polymer) | | — | — | — | 2.0 | — | — | — |
| | | — | Viscosity index improver (3) (containing 19 wt % of PMA) | | — | — | — | — | — | — | — |
| | Detergent dispersant | (B1) | Potassium triborate | [K]* | 0.02 | 0.02 | 0.02 | 0.02 | 0.02 | 0.02 | 0.02 |
| | | | | [B]* | 0.02 | 0.02 | 0.02 | 0.02 | 0.02 | 0.02 | 0.02 |
| | | (B2) | Calcium-containing detergent | [Ca]* | 0.10 | 0.10 | 0.10 | 0.10 | 0.10 | 0.08 | 0.12 |
| | | (B3) | Alkenylsuccinimide | [N]* | 0.09 | 0.09 | 0.09 | 0.09 | 0.09 | 0.09 | 0.09 |
| | | | Boronated alkenylsuccinimide | [N]* | 0.02 | 0.02 | 0.02 | 0.02 | 0.02 | 0.02 | 0.02 |
| | | | | [B]* | 0.03 | 0.03 | 0.03 | 0.03 | 0.03 | 0.03 | 0.03 |
| | Friction modifier | (C) | MoDTC | [Mo]* | 0.05 | 0.02 | 0.08 | 0.05 | 0.05 | 0.05 | 0.05 |
| | Anti-wear agent | — | ZnDTP | [P]* | 0.08 | 0.08 | 0.08 | 0.08 | 0.08 | 0.08 | 0.08 |
| Content of the main resin component included as the viscosity index improver (mass %, on a basis of the total amount of the composition) | | | | | 0.83 | 0.83 | 0.83 | 0.84 | 0.83 | 0.83 | 0.83 |
| Total content of alkali metal atom and alkaline earth metal atom (mass ppm) | | | | | 1200 | 1200 | 1200 | 1200 | 1200 | 1000 | 1400 |
| Evaluation of detergency | | | Grade point of hot tube test (300° C.) | | 7 | 8 | 6 | 7 | 7 | 7 | 8 |

| | | | | Base of content | Example 8 | 9 | 10 | 11 | 12 | 13 | 14 |
|---|---|---|---|---|---|---|---|---|---|---|---|
| Composition (mass %) | Base oil | — | Mineral oil (Group III) | Total amount of composition | Reg. | Reg.** | Reg.** | Reg.** | Reg.** | Reg.** | Reg.** |
| | | | Synthetic oil (PAO) | | 10.0 | 10.0 | 10.0 | 10.0 | 10.0 | 10.0 | 10.0 |
| | Viscosity index improver | (A) | Viscosity index improver (1) (containing 19 wt % of comb-shaped polymer) | | 3.2 | 3.2 | 3.2 | 5.0 | 1.0 | 3.5 | 3.0 |
| | | | Viscosity index improver (2) (containing 42 wt % of comb-shaped polymer) | | — | — | — | — | — | — | — |

TABLE 1-continued

| | | | | | | | | | | | |
|---|---|---|---|---|---|---|---|---|---|---|---|
| | — | Viscosity index improver (3) (containing 19 wt % of PMA) | | — | — | — | — | — | — | — |
| Detergent dispersant | (B1) | Potassium triborate | [K]* | 0.02 | 0.01 | 0.03 | 0.02 | 0.02 | 0.02 | 0.02 |
| | | | [B]* | 0.02 | 0.01 | 0.03 | 0.02 | 0.02 | 0.02 | 0.02 |
| | (B2) | Calcium-containing detergent | [Ca]* | 0.15 | 0.10 | 0.10 | 0.10 | 0.10 | 0.10 | 0.10 |
| | (B3) | Alkenylsuccinimide | [N]* | 0.09 | 0.09 | 0.09 | 0.06 | 0.12 | 0.09 | 0.09 |
| | | Boronated alkenylsuccinimide | [N]* | 0.02 | 0.02 | 0.02 | 0.02 | 0.02 | 0.01 | 0.05 |
| | | | [B]* | 0.03 | 0.03 | 0.03 | 0.03 | 0.03 | 0.01 | 0.05 |
| Friction modifier | (C) | MoDTC | [Mo]* | 0.05 | 0.05 | 0.05 | 0.05 | 0.05 | 0.05 | 0.05 |
| Anti-wear agent | — | ZnDTP | [P]* | 0.08 | 0.08 | 0.08 | 0.08 | 0.08 | 0.08 | 0.08 |
| Content of the main resin component included as the viscosity index improver (mass %, on a basis of the total amount of the composition) | | | | 0.83 | 0.83 | 0.83 | 1.30 | 0.26 | 0.91 | 0.78 |
| Total content of alkali metal atom and alkaline earth metal atom (mass ppm) | | | | 1700 | 1100 | 1300 | 1200 | 1200 | 1200 | 1200 |
| Evaluation of detergency | | Grade point of hot tube test (300° C.) | | 9 | 6 | 7 | 6 | 8 | 7 | 6 |

| | | | | Base of content | Comparative Example 1 | 2 | 3 | 4 | 5 |
|---|---|---|---|---|---|---|---|---|---|
| Composition (mass %) | Base oil | — | Mineral oil (Group III) | Total amount of composition | Reg.** | Reg.** | Reg.** | Reg.** | Reg.** |
| | | | Synthetic oil (PAO) | | 10.0 | 10.0 | 10.0 | 10.0 | 10.0 |
| | Viscosity index improver | (A) | Viscosity index improver (1) (containing 19 wt % of comb-shaped polymer) | | — | 3.2 | — | — | — |
| | | | Viscosity index improver (2) (containing 42 wt % of comb-shaped polymer) | | — | | — | — | — |
| | | — | Viscosity index improver (3) (containing 19 wt % of PMA) | | 4.0 | — | 4.0 | 7.0 | 7.0 |
| | Detergent dispersant | (B1) | Potassium triborate | [K]* | 0.02 | — | — | 0.02 | — |
| | | | | [B]* | 0.02 | — | — | 0.02 | — |
| | | (B2) | Calcium-containing detergent | [Ca]* | 0.10 | 0.10 | 0.10 | 0.10 | 0.10 |
| | | (B3) | Alkenylsuccinimide | [N]* | 0.09 | 0.09 | 0.09 | 0.06 | 0.06 |
| | | | Boronated alkenylsuccinimide | [N]* | 0.02 | 0.02 | 0.02 | 0.02 | 0.02 |
| | | | | [B]* | 0.03 | 0.03 | 0.03 | 0.03 | 0.03 |
| | Friction modifier | (C) | MoDTC | [Mo]* | 0.05 | 0.05 | 0.05 | 0.05 | 0.05 |
| | Anti-wear agent | — | ZnDTP | [P]* | 0.08 | 0.08 | 0.08 | 0.08 | 0.08 |
| Content of the main resin component included as the viscosity index improver (mass %, on a basis of the total amount of the composition) | | | | | 0.76 | 0.83 | 0.76 | 1.33 | 1.33 |
| Total content of alkali metal atom and alkaline earth metal atom (mass ppm) | | | | | 1200 | 1000 | 1000 | 1200 | 1000 |
| Evaluation of detergency | | | Grade point of hot tube test (300° C.) | | 5 | 4 | 4 | 4 | 2 |

*Content in terms of the atom within [ ]

**"Reg." means "Regulated".

<Sequence IIIG Test>

The measurement was performed in conformity with ASTM D7320, and the evaluation was made in terms of a weighted piston deposit (WPD) grade point. It is meant that as the WPD grade point is high, the detergency is favorable. As for the grade point, though Points 4.0 or more are evaluated to be acceptable, Points 4.5 or more are preferred, and Points 5.0 or more are more preferred.

TABLE 2

| | | | | Base of content | Example 2 | Comparative Example 5 |
|---|---|---|---|---|---|---|
| Composition (mass %) | Base oil | — | Mineral oil (Group III) | Total amount of composition | Regulated | Regulated |
| | | | Synthetic oil (PAO) | | 10.0 | 10.0 |
| | Viscosity index improver | (A) | Viscosity index improver (1) (containing 19 wt % of comb-shaped polymer) | | 3.2 | — |
| | | — | Viscosity index improver (3) (containing 19 wt % of PMA) | | — | 7.0 |
| | Detergent dispersant | (B1) | Potassium triborate | [K]* | 0.02 | — |
| | | | | [B]* | 0.02 | — |
| | | (B2) | Calcium-containing detergent | [Ca]* | 0.10 | 0.10 |
| | | (B3) | Alkenylsuccinimide | [N]* | 0.09 | 0.06 |

TABLE 2-continued

| | | | Base of content | Example 2 | Comparative Example 5 |
|---|---|---|---|---|---|
| | | Boronated alkenylsuccinimide | [N]* | 0.02 | 0.02 |
| | | | [B]* | 0.03 | 0.03 |
| Friction modifier | (C) | MoDTC | [Mo]* | 0.02 | 0.05 |
| Anti-wear agent | — | ZnDTP | [P]* | 0.08 | 0.08 |
| Content of the main resin component included as the viscosity index improver (mass %, on a basis of the total amount of the composition) | | | | 0.83 | 1.33 |
| Total content of alkali metal atom and alkaline earth metal atom (mass ppm) | | | | 1200 | 1000 |
| Evaluation of detergency | | Grade point of Sequence IIIG test | | 5.7 | 3.1 |

*Content in terms of the atom within [ ]

It is noted from Table 1 that as compared with the lubricating oil compositions of Comparative Examples 1 to 5, the lubricating oil compositions of Examples 1 to 14 are high in the grade point of the hot tube test at 300° C. and excellent in detergency.

Furthermore, from Table 2, as compared with Comparative Example 5 with a low grade point of the hot tube test, Example 2 with a high grade point of the hot tube test revealed the results in which the grade point of the "Sequence IIIG test" is high, too. From this fact, it may be said that there is a correlation in the results between the "grade point of hot tube test" described in Table 1 and the "Sequence IIIG test".

In view of the results of Tables 1 and 2, it can be said that the lubricating oil composition according to the embodiment of the present invention is suitable as a lubricating oil for direct-injection supercharged engines.

[Evaluation of Fuel Saving Properties Based on Values of Kinematic Viscosity and Viscosity Index of Lubricating Oil Composition]

Example 1 and Comparative Examples 1, 6, and 7

With respect to Comparative Examples 6 and 7, the base oil and the various additives of the kind and blending amounts shown in Table 3 were blended to prepare lubricating oil compositions so as to have an HTHS viscosity at 150° C. of 2.6 mPa·s.

The lubricating oil compositions of Example 1 and Comparative Example 1 described in Table 1 (also described in Table 3) and the lubricating oil compositions of Comparative Examples 6 and 7 described in Table 3 were measured for kinematic viscosities at 40° C. and 100° C. and viscosity index according to the following methods and evaluated for fuel saving properties based on these measured values. The results are shown in Table 3.

<Kinematic Viscosities at 40° C. and 100° C.>

The measurement was performed in conformity with JIS K2283.

<Viscosity Index>

The measurement was performed in conformity with JIS K2283.

TABLE 3

| | | | | Base of content | Example 1 | Comparative Example 1 | 6 | 7 |
|---|---|---|---|---|---|---|---|---|
| Composition (mass %) | Base oil | — | Mineral oil (Group III) | Total amount of composition | Regulated | Regulated | Regulated | Regulated |
| | | | Synthetic oil (PAO) | | 10.0 | 10.0 | 10.0 | 10.0 |
| | Viscosity index improver | (A) | Viscosity index improver (1) (containing 19 wt % of comb-shaped polymer) | | 3.2 | — | — | — |
| | | — | Viscosity index improver (3) (containing 19 wt % of PMA) | | — | 4.0 | — | — |
| | | — | Viscosity index improver (4) (containing 6 wt % of OCP) | | — | — | 2.9 | — |
| | | — | Viscosity index improver (5) (containing 11 wt % of star-shaped polymer) | | — | — | — | 2.5 |
| | Detergent dispersant | (B1) | Potassium triborate | [K]* | 0.02 | 0.02 | 0.02 | 0.02 |
| | | | | [B]* | 0.02 | 0.02 | 0.02 | 0.02 |
| | | (B2) | Calcium-containing detergent | [Ca]* | 0.10 | 0.10 | 0.10 | 0.10 |
| | | (B3) | Alkenylsuccinimide | [N]* | 0.09 | 0.09 | 0.09 | 0.09 |
| | | | Boronated alkenylsuccinimide | [N]* | 0.02 | 0.02 | 0.02 | 0.02 |
| | | | | [B]* | 0.03 | 0.03 | 0.03 | 0.03 |
| | Friction modifier | (C) | MoDTC | [Mo]* | 0.05 | 0.05 | 0.05 | 0.05 |
| | Anti-wear agent | — | ZnDTP | [P]* | 0.08 | 0.08 | 0.08 | 0.08 |
| Content of the main resin component included as the viscosity index improver (mass %, on a basis of the total amount of the composition) | | | | | 0.83 | 0.76 | 0.17 | 0.28 |
| Total content of alkali metal atom and alkaline earth metal atom (mass ppm) | | | | | 1200 | 1200 | 1200 | 1200 |
| Evaluation of fuel saving properties | | | Kinematic viscosity at 40° C. ($mm^2/s$) | | 35.7 | 39.4 | 41.2 | 41.7 |
| | | | Kinematic viscosity at 100° C. ($mm^2/s$) | | 7.44 | 8.40 | 7.90 | 7.95 |
| | | | Viscosity index | | 182 | 197 | 167 | 166 |

*Content in terms of the atom within [ ]

From Table 3, it can be said that the lubricating oil composition of Example 1 is favorable in viscosity characteristics and excellent in fuel saving properties. On the other hand, as compared with Example 1, the lubricating oil compositions of Comparative Examples 6 and 7 using the viscosity index improver including the olefin copolymer (OCP) or the star-shaped polymer are high in the viscosity index, and it is considered that a change of viscosity by the temperature is large, so that they involve a problem in the fuel consumption.

[Evaluation of Fuel Saving Properties Based on a Value of Coefficient of Friction of Lubricating Oil Composition]

Examples 1 to 3 and Comparative Example 8

With respect to Comparative Example 8, the base oil and the various additives of the kind and blending amounts shown in Table 4 were blended to prepare a lubricating oil composition so as to have an HTHS viscosity at 150° C. of 2.6 mPa·s.

The lubricating oil compositions of Examples 1 to 3 described in Table 1 (also described in Table 4) and the lubricating oil composition of Comparative Example 8 described in Table 4 were measured for a coefficient of friction according to the following method and evaluated for fuel saving properties based on the value of coefficient of friction. The results are shown in Table 4.

<Coefficient of Friction (HFRR Test)>

Using an HFRR tester (manufactured by PCS Instruments), a coefficient of friction of each of the lubricating oil compositions prepared in the Examples and Comparative Example was measured under the following conditions. It can be said that as the coefficient of friction is low, the friction reducing effect is excellent, and the fuel saving properties are favorable.

Test piece: (A) ball=HFRR standard test piece (AISI 52100 material), (B) disk=HFRR standard test piece (AISI 52100 material)

Amplitude: 1.0 mm

Frequency: 50 Hz

Load: 5 g

Temperature: 80° C.

From Table 4, the lubricating oil compositions of Examples 1 to 3 are low in the coefficient of friction, so that it can be said that they are excellent in fuel saving properties. On the other hand, as compared with Examples 1 to 3, the lubricating oil composition of Comparative Example 8 in which the molybdenum-containing friction modifier is not blended is high in the coefficient of friction, resulting in inferior fuel saving properties.

[LSPI-Preventing Properties of Lubricating Oil Composition]

Examples 1 and 7 and Comparative Examples 9 and 10

With respect to Comparative Examples 9 and 10, the base oil and the various additives of the kind and blending amounts shown in Table 5 were blended to prepare lubricating oil compositions so as to have an HTHS viscosity at 150° C. of 2.6 mPa·s.

The lubricating oil compositions of Examples 1 and 7 described in Table 1 (also described in Table 5) and the lubricating oil compositions of Comparative Examples 9 and 10 described in Table 5 were measured for a maximum value of heat flow according to the following method and evaluated for LSPI-preventing properties based on the maximum value of heat flow. The results are shown in Table 5.

<Maximum Value of Heat Flow>

With respect to the prepared lubricating oil compositions, the generation of a heat flow following an increase of temperature using a high-pressure differential scanning calorimeter was analyzed. In general, in lubricating oil compositions, when the temperature is increased, instantaneous heat generation is caused at a specified temperature, resulting in combustion. On the occasion of causing the instantaneous heat generation at this time, as the quantity of heat generation is large, a combustion reaction is liable to be caused within a combustion chamber, namely LSPI is likely induced. Then, a maximum value of heat flow corresponding to the heat generation rate was determined on a basis of the quantity of heat generation when the instantaneous heat generation was caused. It may be said that the smaller the foregoing value, the more favorable the LSPI-preventing properties are.

TABLE 4

| | | | | Base of content | Example 1 | Example 2 | Example 3 | Comparative Example 8 |
|---|---|---|---|---|---|---|---|---|
| Composition (mass %) | Base oil | — | Mineral oil (Group III) | Total amount of composition | Regulated | Regulated | Regulated | Regulated |
| | | | Synthetic oil (PAO) | | 10.0 | 10.0 | 10.0 | 10.0 |
| | Viscosity index improver | (A) | Viscosity index improver (1) (containing 19 wt % of comb-shaped polymer) | | 3.2 | 3.2 | 3.2 | 3.2 |
| | Detergent dispersant | (B1) | Potassium triborate | [K]* | 0.02 | 0.02 | 0.02 | 0.02 |
| | | | | [B]* | 0.02 | 0.02 | 0.02 | 0.02 |
| | | (B2) | Calcium-containing detergent | [Ca]* | 0.10 | 0.10 | 0.10 | 0.10 |
| | | (B3) | Alkenylsuccinimide | [N]* | 0.09 | 0.09 | 0.09 | 0.09 |
| | | | Boronated alkenylsuccinimide | [N]* | 0.02 | 0.02 | 0.02 | 0.02 |
| | | | | [B]* | 0.03 | 0.03 | 0.03 | 0.03 |
| | Friction modifier | (C) | MoDTC | [Mo]* | 0.05 | 0.02 | 0.08 | — |
| | Anti-wear agent | — | ZnDTP | [P]* | 0.08 | 0.08 | 0.08 | 0.08 |
| Content of the main resin component included as the viscosity index improver (mass %, on a basis of the total amount of the composition) | | | | | 0.83 | 0.83 | 0.83 | 0.83 |
| Total content of alkali metal atom and alkaline earth metal atom (mass ppm) | | | | | 1200 | 1200 | 1200 | 1200 |
| Evaluation of fuel saving properties | | | Coefficient of friction (HFRR test) | | 0.06 | 0.10 | 0.05 | 0.15 |

*Content in terms of the atom within [ ]

TABLE 5

| | | | | Base of content | Example 1 | Example 7 | Comparative Example 9 | Comparative Example 10 |
|---|---|---|---|---|---|---|---|---|
| Composition (mass %) | Base oil | — | Mineral oil (Group III) | Total amount of composition | Regulated | Regulated | Regulated | Regulated |
| | | | Synthetic oil (PAO) | | 10.0 | 10.0 | 10.0 | 10.0 |
| | Viscosity index improver | (A) | Viscosity index improver (1) (containing 19 wt % of comb-shaped polymer) | | 3.2 | 3.2 | 3.2 | 3.2 |
| | Detergent dispersant | (B1) | Potassium triborate | [K]* | 0.02 | 0.02 | 0.02 | 0.02 |
| | | | | [B]* | 0.02 | 0.02 | 0.02 | 0.02 |
| | | (B2) | Calcium-containing detergent | [Ca]* | 0.10 | 0.12 | 0.20 | 0.23 |
| | | (B3) | Alkenylsuccinimide | [N]* | 0.09 | 0.09 | 0.09 | 0.09 |
| | | | Boronated alkenylsuccinimide | [N]* | 0.02 | 0.02 | 0.02 | 0.02 |
| | | | | [B]* | 0.03 | 0.03 | 0.03 | 0.03 |
| | Friction modifier | (C) | MoDTC | [Mo]* | 0.05 | 0.05 | 0.05 | 0.05 |
| | Anti-wear agent | — | ZnDTP | [P]* | 0.08 | 0.08 | 0.08 | 0.08 |
| | Content of the man resin component included as the viscosity index improver (mass %, on a basis of the total amount of the composition) | | | | 0.83 | 0.83 | 0.83 | 0.83 |
| | Total content of alkali metal atom and alkaline earth metal atom (mass ppm) | | | | 1200 | 1400 | 2200 | 2500 |
| Evaluation of LSPI-preventing properties | | | Maximum value of heat flow (mW) | | 337 | 339 | 342 | 342 |

*Content in terms of the atom within [ ]

From Table 5, it is noted that the lubricating oil compositions of Examples 1 and 7 are small in the maximum value of heat flow and hence, are excellent in LSPI-preventing properties.

On the other hand, as compared with Examples 1 and 7, the lubricating oil compositions of Comparative Examples 9 and 10 in which the total content of the alkali metal atom and the alkaline earth metal atom is more than 2,000 ppm are high in the maximum value of heat flow, so that it may be said that they are inferior in LSPI-preventing properties.

The invention claimed is:

1. A lubricating oil composition, comprising:

a base oil;

a viscosity index improver (A) comprising a comb-shaped polymer (A1) having a weight average molecular weight (Mw) of 420,000 to 650,000;

a detergent dispersant (B) comprising:

an alkali metal borate (B1), an organometallic compound (B2) comprising a metal atom selected from the group consisting of an alkali metal atom and an alkaline earth metal atom, and a compound (B3) consisting of a non-boronated alkenylsuccinimide and a boronated alkenylsuccinimide;

a friction modifier (C) comprising a molybdenum-containing friction modifier; and a zinc dialkyldithiophosphate, wherein:

the comb-shaped polymer (A1) is a copolymer comprising a constituent unit derived from a macromonomer (I') and a constituent unit derived from a monomer (II') that is different from the macromonomer (I');

a number average molecular weight (Mn) of the macromonomer (I') is 700 or more, and 200,000 or less;

the macromonomer (I') comprises a polymerizable functional group including a methacryloyl group ($CH_2{=}CCH_3{-}COO{-}$);

the monomer (II') is at least one selected from the group consisting of an alkyl (meth)acrylate (b) having an alkyl group with a carbon number of 1 to 26, and a monomer (a) represented by formula (a1):

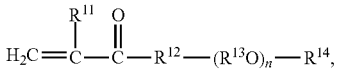

(a1)

where:

$R^{11}$ represents a hydrogen atom or a methyl group, $R^{12}$ represents a single bond, a linear or branched alkylene group having a carbon number of 1 to 10, —O—, or —NH—, $R^{13}$ represents a linear or branched alkylene group having a carbon number of 2 to 4, n represents an integer of 1 to 20 such that, when n is an integer of 2 or more, plural $R^{13}$s may be the same as or different from each other, and $(R^{13}O)_n$ may be either a random bond or a block bond, and $R^{14}$ represents a linear or branched alkyl group having a carbon number of 1 to 60;

a content of the comb-shaped polymer (A1) is 0.15 to 3 mass %, based on a total mass of the lubricating oil composition;

the alkali metal borate (B1) is selected from the group consisting of sodium tetraborate, sodium pentaborate, sodium hexaborate, sodium octaborate, sodium diborate, potassium metaborate, potassium triborate, potassium tetraborate, potassium pentaborate, potassium hexaborate, potassium octaborate, and the hydrate thereof;

a content of the alkali metal borate (B1) is 0.01 to 0.05 mass % in terms of boron atom, based on the total mass of the lubricating oil composition;

the metal atom of the organometallic compound (B2) is at least one selected from the group consisting of a sodium atom, a calcium atom, a magnesium atom and a barium atom;

the organometallic compound (B2) is at least one selected from the group consisting of a metal salicylate, a metal phenate and a metal sulfonate;

a content of the organometallic compound (B2) is 0.05 to 0.18 mass % in terms of the metal atom, based on the total mass of the lubricating oil composition;

a total content of alkali metal atom and alkaline earth metal atom is 2,000 mass ppm or less, based on the total mass of the lubricating oil composition;

a content of the compound (B3) is 0.01 to 0.20 mass % in terms of nitrogen atom, based on the total mass of the lubricating oil composition;

a content of the boronated alkenylsuccinimide in terms of a boron atom is 0.005 to 0.07 mass % based on the total mass of the lubricating oil composition;

a mass ratio of a content (i) of the alkenylsuccinimide in terms of a nitrogen atom and the content (ii) of the boronated alkenylsuccinimide in terms of the boron atom, [(i)/(ii)] is 1/1 to 15/1;

a content of the molybdenum-containing friction modifier is 0.015 to 0.08 mass % in terms of molybdenum atom, based on the total mass of the lubricating oil composition; and a content of the zinc dialkyldithiophosphate is 0.01 to 0.2 mass % in terms of phosphorus atom, based on the total mass of the lubricating oil composition.

2. The lubricating oil composition according to claim 1, wherein a weight average molecular weight (Mw) of the comb-shaped polymer (A1) is 420,000 to 500,000.

3. The lubricating oil composition according to claim 1, wherein a content of the comb-shaped polymer (A1) is 0.2 to 3 mass %, based on the total mass of the lubricating oil composition.

4. The lubricating oil composition according to claim 1, wherein a mass ratio of a content of the comb-shaped polymer (A1), and a content of the alkali metal borate (B1) in terms of mass boron, [(A1)/(B1)], is from 12/1 to 100/1.

5. The lubricating oil composition according to claim 1, wherein the alkali metal atom comprised in the alkali metal borate (B1) is a potassium atom.

6. The lubricating oil composition according to claim 1, wherein the metal atom comprised in the organometallic compound (B2) is a calcium atom or a magnesium atom.

7. The lubricating oil composition according to claim 1, wherein the organometallic compound (B2) is at least one selected from the group consisting of a metal salicylate and a metal sulfonate.

8. The lubricating oil composition according to claim 1, wherein a content of the molybdenum-containing friction modifier in terms of mass of a molybdenum atom is 0.02 to 0.08 mass %, based on the total mass of the lubricating oil composition.

9. The lubricating oil composition according to claim 1, wherein a total content of a sodium atom, a calcium atom, a magnesium atom, and a barium atom is 1,900 mass ppm or less, based on the total mass of the lubricating oil composition.

10. The lubricating oil composition according to claim 1, wherein a content of a calcium atom is 1,900 mass ppm or less, based on the total mass of the lubricating oil composition.

11. The lubricating oil composition according to claim 1, wherein a mass ratio of (i) a content of the organometallic compound (B2) in terms of mass of the metal atom selected from the group consisting of the alkali metal atom and the alkaline earth metal atom and (ii) a content of the alkali metal borate (B1) in terms of mass boron, [(B2)/(B1)], is from 1/1 to 15/1.

12. The lubricating oil composition according to claim 5, wherein a content of a potassium atom is 0.01 to 0.10 mass %, based on the total mass of the lubricating oil composition.

13. The lubricating oil composition according to claim 1, wherein a content of a polymethacrylate compound not corresponding to the comb-shaped polymer (A1) is 0 to 30 parts by mass relative to 100 parts by mass of the comb-shaped polymer (A1).

14. The lubricating oil composition according to claim 1, wherein the base oil is at least one selected from the group consisting of a mineral oil and a synthetic oil classified into Group 3 of the base stock categories of the API (American Petroleum Institute).

15. The lubricating oil composition according to claim 1, which is adapted to function as a lubricating oil composition for use in direct-injection supercharged gasoline engines.

16. A lubricating oil composition, comprising:

a base oil;

a viscosity index improver (A) comprising a comb-shaped polymer (A1) having a weight average molecular weight (Mw) of 420,000 to 650,000;

a detergent dispersant (B) comprising:

an alkali metal borate (B1), an organometallic compound (B2) comprising a metal atom selected from the group consisting of an alkali metal atom and an alkaline earth metal atom, and a compound (B3) consisting of a non-boronated alkenylsuccinimide and a boronated alkenylsuccinimide;

a friction modifier (C) comprising a molybdenum-containing friction modifier; and a zinc dialkyldithiophosphate, wherein:

a content of a calcium atom is 1,900 mass ppm or less;

the comb-shaped polymer (A1) is a copolymer comprising a constituent unit derived from a macromonomer (I') and a constituent unit derived from a monomer (II') that is different from the macromonomer (I');

a number average molecular weight (Mn) of the macromonomer (I') is 700 or more, and 200,000 or less;

the macromonomer (I') comprises a polymerizable functional group including a methacryloyl group ($CH_2{=}CCH_3{-}COO{-}$);

the monomer (II') is at least one selected from the group consisting of an alkyl (meth)acrylate (b) having an alkyl group with a carbon number of 1 to 26, and a monomer (a) represented by formula (a1):

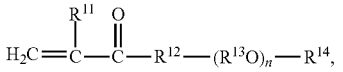

(a1)

where:

$R^{11}$ represents a hydrogen atom or a methyl group, $R^{12}$ represents a single bond, a linear or branched alkylene group having a carbon number of 1 to 10, —O—, or —NH—, $R^{13}$ represents a linear or branched alkylene group having a carbon number of 2 to 4, n represents an integer of 1 to 20 such that, when n is an integer of 2 or more, plural $R^{13}$s may be the same as or different from each other, and $(R^{13}O)_n$ may be either a random bond or a block bond, and $R^{14}$ represents a linear or branched alkyl group having a carbon number of 1 to 60, a content of the comb-shaped polymer (A1) is 0.15 to 3 mass %, based on a total mass of the lubricating oil composition;

the alkali metal borate (B1) is selected from the group consisting of sodium tetraborate, sodium pentaborate, sodium hexaborate, sodium octaborate, sodium diborate, potassium metaborate, potassium triborate, potassium tetraborate, potassium pentaborate, potassium hexaborate, potassium octaborate, and the hydrate thereof;

a content of the alkali metal borate (B1) is 0.01 to 0.05 mass % in terms of boron atom, based on the total mass of the lubricating oil composition;

the metal atom of the organometallic compound (B2) is at least one selected from the group consisting of a sodium atom, a calcium atom, a magnesium atom and a barium atom;

the organometallic compound (B2) is at least one selected from the group consisting of a metal salicylate, a metal phenate and a metal sulfonate;

a content of the organometallic compound (B2) is 0.05 to 0.18 mass % in terms of the metal atom, based on the total mass of the lubricating oil composition;

a content of the compound (B3) is 0.01 to 0.20 mass % in terms of nitrogen atom, based on the total mass of the lubricating oil composition;

a content of the boronated alkenylsuccinimide in terms of a boron atom is 0.005 to 0.07 mass % based on the total mass of the lubricating oil composition;

a mass ratio of a content (i) of the alkenylsuccinimide in terms of a nitrogen atom and the content (ii) of the boronated alkenylsuccinimide in terms of the boron atom, [(i)/(ii)] is 1/1 to 15/1;

a content of the molybdenum-containing friction modifier is 0.015 to 0.08 mass % in terms of molybdenum atom, based on the total mass of the lubricating oil composition; and a content of the zinc dialkyldithiophosphate is 0.01 to 0.2 mass % in terms of phosphorus atom, based on the total mass of the lubricating oil composition.

17. A method, comprising operating a direct-injection supercharged gasoline engine containing the lubricating oil composition according to claim 1.

18. A method for producing the lubricating oil composition of claim 1, the method comprising blending the base oil with:

the viscosity index improver (A);

the detergent dispersant (B);

the friction modifier (C); and the zinc dialkyldithiophosphate.

19. The lubricating oil composition according to claim 1, wherein the content of the boronated alkenylsuccinimide in terms of a boron atom is 0.01 to 0.07 mass % based on the total mass of the lubricating oil composition.

20. The lubricating oil composition according to claim 1, wherein the mass ratio of a content (i) of the alkenylsuccinimide in terms of a nitrogen atom and the content (ii) of the boronated alkenylsuccinimide in terms of the boron atom, [(i)/(ii)] is 2/1 to 10/1.

* * * * *